US010675674B2

(12) United States Patent
Lim et al.

(10) Patent No.: US 10,675,674 B2
(45) Date of Patent: Jun. 9, 2020

(54) CASTING MOLD FOR METAL SHEET

(71) Applicant: Korea Institute of Machinery & Materials, Daejeon (KR)

(72) Inventors: Ka Ram Lim, Changwon-si (KR); Young Sang Na, Changwon-si (KR)

(73) Assignee: Korea Institute of Machinery & Materials, Daejeon (KR)

( * ) Notice: Subject to any disclaimer, the term of this patent is extended or adjusted under 35 U.S.C. 154(b) by 0 days.

(21) Appl. No.: 16/064,693

(22) PCT Filed: Jun. 13, 2017

(86) PCT No.: PCT/KR2017/006134
§ 371 (c)(1),
(2) Date: Jun. 21, 2018

(87) PCT Pub. No.: WO2017/217733
PCT Pub. Date: Dec. 21, 2017

(65) Prior Publication Data

US 2019/0001401 A1 Jan. 3, 2019

(30) Foreign Application Priority Data

Jun. 13, 2016 (KR) ..... 10-2016-0073011
Feb. 9, 2017 (KR) ..... 10-2017-0018305

(51) Int. Cl.
*B22C 9/06* (2006.01)
*B22D 18/06* (2006.01)
(Continued)

(52) U.S. Cl.
CPC ..... *B22C 9/061* (2013.01); *B22C 9/06* (2013.01); *B22C 9/067* (2013.01); *B22C 9/08* (2013.01);
(Continued)

(58) Field of Classification Search
CPC ..... B22D 18/06; B22D 27/15; B22C 9/06; B22C 9/067
See application file for complete search history.

(56) References Cited

U.S. PATENT DOCUMENTS 5,706,880 A 1/1998 Ohnuma et al.
5,740,854 A 4/1998 Inoue et al.
(Continued)

FOREIGN PATENT DOCUMENTS

GB 2270145 A * 3/1994 ..... B22D 27/13
JP 59110456 A * 6/1984 ..... B22D 27/15
(Continued)

OTHER PUBLICATIONS

International Search Report PCT/ISA/210 for International Application No. PCT/KR2016/013817 dated Mar. 3, 2017.
(Continued)

*Primary Examiner* — Kevin E Yoon
(74) *Attorney, Agent, or Firm* — Harness, Dickey & Pierce, P.L.C.

(57) ABSTRACT

The present invention relates to a casting mold for a metal sheet by drawing molten metal into a mold cavity and cooling the molten metal, and the casting mold according to the present invention includes: a support portion at an upper side on which molten metal is disposed or a solid metal is placed and melted; a mold cavity at a lower side in which the metal sheet is formed as the molten metal is drawn from the support portion while filling the mold cavity and cooled; and a passageway through which the molten metal is drawn into the mold cavity from the support portion, in which the mold cavity includes a first surface at the upper side which communicates with the passageway, and a second surface at the lower side which faces the first surface, a plurality of suction portions for drawing the molten metal are formed in the second surface and extended downward from the second
(Continued)

surface, the suction portions are connected to a vacuum source and configured to draw the molten metal by suctioning air from the mold cavity, and a blocking member, which is in contact with the second surface or the suction portions to prevent a leakage of the molten metal and allow an air flow, is disposed on the suction portions in the mold cavity.

16 Claims, 18 Drawing Sheets

(51) Int. Cl.

| | |
|---|---|
| ***B22D 27/15*** | (2006.01) |
| ***B22C 9/08*** | (2006.01) |
| ***B22D 11/055*** | (2006.01) |
| *B22C 9/12* | (2006.01) |
| *B22D 18/04* | (2006.01) |

(52) U.S. Cl.
CPC ..... *B22D 11/055* (2013.01); *B22D 18/06* (2013.01); *B22D 27/15* (2013.01); *B22C 9/12* (2013.01); *B22D 18/04* (2013.01)

(56) References Cited

U.S. PATENT DOCUMENTS 6,044,893 A 4/2000 Taniguchi et al.
6,253,828 B1 * 7/2001 Reiter ..... B22D 18/06 164/258
2008/0078523 A1 4/2008 Ide et al.
2013/0333814 A1 * 12/2013 Fleury ..... B22D 18/06 148/561

FOREIGN PATENT DOCUMENTS

| | | | | |
|---|---|---|---|---|
| JP | H08109419 | A | | 4/1996 |
| JP | H08206815 | A | | 8/1996 |
| JP | H10296424 | A | | 11/1998 |
| JP | 2000271730 | A | | 10/2000 |
| JP | 2001009563 | A | | 1/2001 |
| JP | 2008161916 | A | | 7/2008 |
| JP | 2009090334 | A | | 4/2009 |
| JP | 2009255109 | A | | 11/2009 |
| JP | 2014039936 | A | * | 3/2014 |
| JP | 2014140879 | A | | 8/2014 |
| KR | 100846818 | B1 | | 7/2008 |
| KR | 101229064 | B1 | | 2/2013 |

OTHER PUBLICATIONS

International Search Report PCT/ISA/210 for International Application No. PCT/KR2017/006134 dated Aug. 11, 2017.

* cited by examiner

CASTING MOLD FOR METAL SHEET

CROSS-REFERENCE TO RELATED APPLICATIONS

This application is a national phase under 35 U.S.C. § 371 of PCT International Application No. PCT/KR2017/006134 which has an International filing date of Jun. 13, 2017, which claims priority to Korean Application No. 10-2016-0073011, filed Jun. 13, 2016, and Korean Application No. 10-2017-0018305, filed Feb. 9, 2017, the entire contents of each of which are hereby incorporated by reference.

TECHNICAL FIELD

The present invention relates to a casting mold for a metal sheet, and particularly, to a casting mold configured to cast a metal sheet by drawing molten metal into a cavity of the mold and then cooling the molten metal.

BACKGROUND ART

Various casting molds and casting methods are used for metal casting, and as a metal casting methods for rapidly casting an metal product, that is, a metal casting method for rapidly cooling molten metal, a method is used which rapidly injects molten metal into a mold cavity by using gravity or by drawing the molten metal and transfers heat to the mold, thereby casting a solid metal product from the liquid molten metal.

The casting method is mainly used to manufacture a specimen made of an amorphous alloy, but there is a problem in that it is necessary to rapidly cool molten metal during the manufacturing process, at a speed higher than a speed at which metal elements form crystal structures, even though the amorphous alloy has no crystal structure and thus has better physical properties such as rigidity than general metal.

As a method of manufacturing the amorphous alloy, as described above, a differential pressure type casting method is used which allows the molten metal to be introduced into a casting mold by gravity or draws the molten metal into a mold cavity by using negative pressure. According to this method, the molten metal is rapidly cooled while flowing through a narrow passageway and filling the narrow passageway, but there occurs frictional force between the molten metal and the passageway while the molten metal flows through the narrow passageway.

Because the method of introducing the molten metal into the mold cavity by using gravity has a problem in that the molten metal cannot quickly flow into the mold cavity due to the frictional force in the narrow passageway, a method is mainly used which casts an amorphous alloy specimen by rapidly drawing the molten metal into the mold cavity by using negative pressure made by suction and by solidifying the molten metal by transferring heat to a main mold body having high thermal conductivity before crystallization of metal, and a casting mold used for the method is mainly used.

As a typical example of a casting mold used for the differential pressure type casting, FIGS. 1A and 1B illustrate a casting mold used to cast a bar-shaped specimen made of an amorphous alloy.

A casting mold 100 includes a main mold body 110 having a mold cavity 111 having a circular cross section that matches with a bar shape of a specimen to be manufactured, and an upper mold 120 which is placed on an upper end surface of the main mold body and has a support portion 121 formed at an upper side of the upper mold 120 so that a metal to be melted is placed on the support portion 121.

The mold cavity 111 has a shape extended from the support portion 121 to a lower end surface of the main mold body 110, and a stopper 130, which prevents a leakage of molten metal, is disposed at a lower end of the mold cavity 111. The stopper 130 has four suction holes 137 that extend from an upper end surface 132 of the stopper 130 to a lower end surface of the stopper 130, and a non-illustrated vacuum suction source is connected to the suction hole 137.

The suction holes 137 are exposed at the upper end surface 132 of the stopper 130, but a portion of the upper end surface 132 of the stopper, where the suction holes 137 are exposed, is in contact with a surface of a stopper insertion groove 112 formed in the lower end surface of the main mold body 110 but is not in direct contact with the mold cavity 110.

Meanwhile, a heating source 2 for heating the metal 1 is disposed above the upper mold 120, and an arc electrode 3 is disposed in the vicinity of the metal and generates an electric arc, thereby melting the metal.

When the metal 1 is melted, the vacuum suction source is operated to perform suction through the suction holes 137. Upper ends of the suction holes 137 are in contact with the surface of the stopper insertion groove 112, but because the upper end surface 132 of the stopper has minute scratches or unevenness caused by machining and thus has high surface roughness, air is suctioned from the mold cavity 111 through the scratches or the unevenness, such that the molten metal 1 on the support portion 121 is drawn into the mold cavity 111 by negative pressure.

A bottom surface of the mold cavity 111 is closed by the upper end surface 132 of the stopper to the extent that the molten metal does not leak to the suction holes 137, such that the molten metal 1 fills the mold cavity 111 from the bottom surface of the mold cavity 111.

The main mold body 110 is made of a material such as copper having high thermal conductivity, and particularly, the main mold body 110 is configured such that a cooling fluid circulates inside or around the main mold body 110, and as a result, the molten metal, which is drawn into and thus fills the mold cavity 111, is rapidly cooled and solidified before crystallization thereof, and formed as amorphous metal.

This type of casting mold is used to cast a bar-shaped metal product, but the inventors of the present invention have made a casting mold illustrated in FIG. 3 in order to use this type of differential pressure type casting mold to manufacture an amorphous alloy in the form of a sheet.

A casting mold 200 illustrated in FIG. 3 is configured by changing a part of a drawing passageway 211 for a molten metal in the casting mold 100 illustrated in FIG. 1, which is vertically extended from the support portion 121 at the upper side to the upper end surface 132 of the stopper at the lower side, into a mold cavity 213 which has a small thickness and a large area so that a metal sheet may be formed, and by allowing the mold cavity 213 to have a shape that is narrowed toward an upper end portion and a lower end portion thereof.

However, several problems are found as a result of casting an amorphous alloy sheet by using the casting mold 200 configured as described above.

First, it is ascertained that casting defects occur at a severe level in the casted alloy specimen because the molten metal non-uniformly flows from an upper end to a lower end of the mold cavity 213. In addition, a discontinuous interface, which is formed due to a difference in metal flow between left and right sides with respect to a vertical path from the upper portion to the lower portion in the mold cavity 213, is observed between the left and right sides.

Therefore, it is ascertained that an appropriate amorphous metal sheet cannot be casted by using the configuration of the differential pressure type casting mold in the related art as it is.

As another method of manufacturing a metal sheet made of an amorphous alloy, there is an invention related to an apparatus and a method of manufacturing a molded body disclosed in Korean Patent No. 10-1229064 (Document 1).

In the invention disclosed in Document 1, a specimen, which is in the form of a sheet and made of an amorphous alloy, is manufactured by placing an alloy material on a support having a flat upper surface, heating and melting the alloy material by using a heater above the alloy material, removing the heater while moving the support upward, moving a chill member upward such that the molten metal is placed between a lower surface of the chill member and an upper surface of the support, and cooling the molten metal by transferring heat to the chill member and the support.

According to the disclosure in Document 1, a small sheet made of an amorphous alloy at a specimen level is manufactured by using the apparatus and the method, but there are problems in that the manufactured sheet has a very irregular surface state such that the manufactured sheet needs to be machined to make a specimen by cutting and removing a significantly large part of a surface of a casted product, quality of the casted specimen is very irregular because the casting is not performed in a sealed mold, and as a result, it is impossible to obtain a shape required as a final product.

Further, according to the method and the apparatus according to the invention disclosed in Document 1, a driving device, which operates the support, the heater, and the chill member, is additionally required in comparison with the casting mold of the type illustrated in FIG. 1, and as a result, there are problems in that a configuration of the apparatus and a control method are very complicated and a large amount of costs is required.

DETAILED DESCRIPTION OF THE INVENTION

Technical Problem

The present invention has been made in consideration of the aforementioned problems in the related art, and an object of the present invention is to provide a casting mold which uses a principle of a differential pressure type casting mold in the related art which performs casting by drawing molten metal into a mold cavity, and may cast a metal in the form of a sheet as a constituent element of an actually and commercially available product instead of a bar-shaped specimen.

In particular, another object of the present invention is to provide a mold for casting a metal sheet which may be used not only to manufacture an amorphous alloy but also to manufacture a metal product that requires a process of rapidly cooling molten metal, and may be configured by adopting a basic configuration of a differential pressure type casting mold in the related art without changing main structures of a casting mold in the related art and using an apparatus that requires precise control and has a complicated configuration.

In addition, still another object of the present invention is to provide a casting mold which is capable of manufacturing an amorphous alloy having a large area which could not be manufactured by an amorphous alloy manufacturing method in the related art, that is, to provide a casting mold having a configuration which is capable of casting metal sheets having various shapes as well as a specimen in the form of a metal sheet having a simple shape.

Technical Solution

Regarding researches and experiments related to the object of the present invention, the inventors of the present invention have considered using the differential pressure type casting mold of the type as illustrated in FIG. 1 which has been used to manufacture a specimen made of an amorphous alloy in the related art.

A casting mold for a metal sheet according to the present invention basically uses a method of introducing molten metal into a mold cavity by drawing the molten metal. The differential pressure type casting method is useful to a casting mold that needs to be configured to manufacture an amorphous alloy and perform rapid cooling because the differential pressure type casting method may comparatively simply and quickly introduce the molten metal into the mold cavity.

However, as described above regarding the casting mold illustrated in FIG. 3, the differential pressure type casting mold in the related art is useful to the method of casting a metal product having a bar shape with a long length, but the differential pressure type casting mold in the related art is not suitable to cast a metal product in the form of a sheet.

As a result of considering the reason why the differential pressure type casting mold in the related art is not suitable to cast a metal product in the form of a sheet, the inventors of the present invention have noted that in the differential pressure type casting mold in the related art, frictional force caused by an inflow of the molten metal has an adverse effect on uniformity and cooling performance of the casted metal product because a direction in which the molten metal is introduced into the mold cavity coincides with a direction in which the molten metal fills the mold cavity, and also have noted that it is useful to make a flow direction of molten metal into the mold cavity different from a flow direction of molten metal that fills the mold cavity.

Therefore, the inventors of the present invention have considered a method of changing a flow direction of molten metal while the molten metal is drawn and introduced into the mold cavity and fills the mold cavity, thereby enabling the molten metal to fill the mold cavity while uniformly flowing in the entire mold cavity.

As a result of repeated consideration, researches, and experiments, the inventors of the present invention have worked out a mold for casting according to the present invention configured as described below.

The present invention relates to a casting mold for a metal sheet by drawing molten metal into a mold cavity and cooling the molten metal, and the casting mold according to the present invention includes: a support portion at an upper side on which molten metal is disposed or a solid metal is placed and melted; a mold cavity at a lower side in which the metal sheet is formed as the molten metal is drawn from the support portion while filling the mold cavity and cooled; and a passageway through which the molten metal is drawn into the mold cavity from the support portion, in which the mold cavity includes a first surface at the upper side which communicates with the passageway, and a second surface at the lower side which faces the first surface, a plurality of suction portions for drawing the molten metal are formed in the second surface and extended downward from the second surface, the suction portions are connected to a vacuum source and configured to draw the molten metal by suctioning air from the mold cavity, and a blocking member, which is in contact with the second surface or the suction portions to prevent a leakage of the molten metal and allow an air flow, is disposed on the suction portions in the mold cavity.

The term 'metal' used throughout the present specification does not mean only particular metal containing a single element, but particularly means various types of alloys including an amorphous alloy and a single element metal.

In addition, throughout the present specification, a product casted by using the casting mold is specified as a sheet, but the term 'sheet' is not limited to an object having two parallel surfaces defining a width and an area, but means an object having a width and an area greater than a thickness.

A process of casting a metal sheet using the casting mold according to the present invention will be described.

A metal, which is used to cast a metal sheet, is melted on the support portion at the upper side of the casting mold or a liquid molten metal is placed on the support portion.

When the suction is performed from the suction portions at the lower side of the casting mold by the external vacuum suction source, negative pressure is applied to the mold cavity through the suction portions. The blocking member is in contact with the suction portion, but does not seal the suction portion, and air flows between the suction portion and the blocking member which are in contact with each other.

The molten metal on the support portion is drawn through the passageway by the negative pressure applied through the mold cavity, and the molten metal is introduced into the mold cavity through the vertical passageway that connects the support portion at the upper side and the mold cavity at the lower side. In particular, in a case in which the negative pressure generated by the external vacuum suction source is sufficiently high, the molten metal may be introduced into the mold cavity, without being cooled in the passageway and remaining in the passageway, against frictional force generated when the molten metal passes through the passageway.

The mold cavity has the two surfaces, that is, the first surface and the second surface, which correspond to a wide surface of a sheet to be casted, such that flow paths of the molten metal are formed in a horizontal direction approximately perpendicular to the vertical direction which is the direction in which the passageway is disposed.

Therefore, the molten metal is introduced into the mold cavity through the passageway exposed to the first surface at the upper side, and forms flows, by the suction from the multiple suction portions formed in the second surface, in directions heading for the suction portions.

According to this configuration, the appropriate and uniform flow of the molten metal and the appropriate and uniform filling of the mold cavity with the molten metal may be performed by adjusting the position of the passageway on the first surface and the arrangement of the multiple suction portions on the second surface.

For example, in a case in which a metal sheet to be casted has a circular shape in a plan view, the first surface and the second surface are formed in a circular shape, the passageway through which the molten metal is introduced from the support portion is formed at a center of the circular first surface, and the suction portions through which air is suctioned are disposed around the circular shape, such that the molten metal is introduced from one point in the circular shape and forms radial flows around the circular shape, uniform frictional force and uniform attractive force are applied to these flows, and the molten metal fills the mold cavity at a very uniform speed, and as a result, the metal product may be formed to have an uniform metal crystal or an amorphous structure without a crystal structure by uniform rapid cooling.

Meanwhile, as a first aspect of the present invention, a main mold body of the present invention, which has the support portion, the mold cavity, and the passageway, may include: an upper mold which has therein the passageway through which the molten metal is drawn into the mold cavity, and has the support portion at the upper side thereof; and a lower mold which is provided at the lower side of the upper mold and defines the mold cavity between the upper mold and the lower mold, in which a surface, which defines the first surface of the mold cavity, is formed at the lower side of the upper mold, and a surface, which defines the second surface of the mold cavity, is formed at the upper side of the lower mold.

This configuration adopts a basic structure of the casting mold in the related art which is configured to cast the bar-shaped amorphous alloy illustrated in FIG. 1.

That is, in the case of the differential pressure type casting mold in the related art, the passageway of the main mold body through which the molten metal is drawn comprises the mold cavity in which the molten metal is filled and cooled, and the stopper having through holes for suctioning air is disposed at the lower end of the main mold body, but in contrast, in the aforementioned aspect of the present invention, the main mold body having the passageway for drawing the molten metal is used as the upper mold, and the lower mold is disposed at a position at which the stopper was disposed, such that the mold cavity is formed between the lower mold and the upper mold.

Therefore, even though the configuration of the casting mold was changed, there is an advantage in that the basic configuration of the casting mold, a source for heating a metal, and a configuration for circulating a cooling fluid, which have been used in the related art, may be used as it is, and particularly, it is possible to cast metal sheets having various shapes by replacing the lower mold that defines the mold cavity.

Meanwhile, there may be the following two embodiments of the blocking member which prevents the molten metal from leaking from the mold cavity to the suction portion and allows the suction from the suction portion.

First, in the case of the aforementioned aspect in which the upper mold and the lower mold are separately formed, a protruding portion, which protrudes toward the mold cavity and is in contact with a portion of the second surface of the mold cavity where the suction portions are formed, may be provided at the lower side of the upper mold, and the protruding portion may define the blocking member.

In this configuration, an outer circumferential surface of the protruding portion may be in contact with a circumferential surface between the first surface and the second surface of the mold cavity, and an inner circumferential surface of the protruding portion, together with the first surface and the second surface of the mold cavity, may define a space corresponding to a shape of the metal sheet.

According to this configuration, the blocking member and the upper mold may be integrally formed without separately providing the blocking member, and as a result, the process of manufacturing the casting mold and the configuration of the casting mold are simplified.

Second, the blocking member may be configured by a ring disposed in the mold cavity, and the ring is disposed on the upper side of the suction portion and is in contact with the circumferential surface of the mold cavity between the first surface and the second surface, a part of the first surface adjacent to the circumferential surface, and a part of the second surface adjacent to the circumferential surface.

The ring-shaped blocking member may be appropriately used in a case in which the suction portions are formed in the second surface of the mold cavity adjacent to the circumferential surface of the mold cavity.

In the case in which the suction portions are formed in the second surface of the mold cavity adjacent to the circumferential surface of the mold cavity and the passageway through which the molten metal is introduced into the mold cavity is disposed at the center of the circumferential surface of the mold cavity, the molten metal is introduced from the center of the mold cavity and forms flow paths toward the circumference of the mold cavity, such that very uniform flows, filling, and cooling may be performed.

With this configuration, the blocking member is formed in a ring shape, and the ring-shaped blocking member is in contact with the circumferential surface of the mold cavity and the first and second surfaces adjacent to the circumferential surface, such that a circumferential shape of a metal sheet to be casted is determined by the inner circumference surface of the ring shape.

Therefore, it is possible to cast metal sheets having various planar shapes by using the same casting mold by changing shapes of the inner circumferential surfaces of the ring-shaped blocking member.

In particular, the ring-shaped blocking member may be replaced after being used once or a predetermined number of times, and as a result, the blocking member may be easily replaced and costs may be reduced in the case in which the molten metal is solidified in and attached to the ring-shaped blocking member.

Meanwhile, the blocking member is in contact with the second surface of the mold cavity to prevent the molten metal from leaking to the suction portion and allow the air suction, and as a result, it is possible to obtain the function of the blocking member by adjusting surface roughness of a surface of the blocking member which is in contact with the second surface of the mold cavity.

That is, the blocking member may have various configurations so as to prevent the leakage of the molten metal and allow the air suction, and among the various configurations, the configuration for adjusting the surface roughness of the blocking member is advantageous in terms of costs and performances.

The surface of the blocking member may be separately processed to adjust the surface roughness, but for example, in the process of manufacturing the blocking member or the upper mold having the blocking member, the portion, which is to be in contact with the second surface, remains in a primarily machined state and thus has a rough surface without polishing or fine machining, such that micro grooves formed by machining remain in the surface of the portion, thereby obtaining required surface roughness.

Meanwhile, as a second aspect of the present invention for obtaining an amorphous alloy sheet with a large area, in the case of the casting mold according to the present invention, a plurality of the support portions and a plurality of the passageways are formed, the molten metal, which is introduced into the mold cavity from the respective passageways, forms flows of the molten metal toward the adjacent suction portions, and the suction portions are disposed between the passageways on a plane of the mold cavity so that the flows of the molten metal are contact with the flows of the molten metal from the adjacent passageways.

The configuration according to the second aspect, together with the configuration according to the first aspect, may be applied to the casting mold according to the present invention.

According to the configuration of the second aspect, the molten metal is introduced into the mold cavity through the multiple passageways exposed to the first surface of the mold cavity, and forms flows, by the suction from the multiple suction portions formed in the second surface, in directions heading for the suction portions.

The molten metal introduced from the passageways flows into the mold cavity from the respective passageways and fills the mold cavity in the form of a sheet while flowing by the air suction from the adjacent suction portions.

The multiple suction portions are disposed around one passageway on a plane of the mold cavity, and the molten metal introduced into the mold cavity from one passageway forms flows of molten metal in several directions by negative pressure from the adjacent suction portions on a plane of the mold cavity.

In addition, the multiple passageways are disposed around one suction portion on a plane of the mold cavity, and the molten metal is drawn from the multiple adjacent passageways by the suction from one suction portion.

Therefore, the flows of the molten metal come into contact with one another while colliding with one another at the positions of the suction portions, and the molten metal is rapidly cooled by the casting mold while filling the mold cavity, thereby forming an integrated and continuous sheet with a large area.

Because uniform frictional force and uniform attractive force are applied to the flows of the molten metal, the molten metal fills the mold cavity at a very uniform speed, and as a result, the metal product may be formed to have an uniform fine structure or an amorphous structure without a crystal structure by uniform rapid cooling.

Furthermore, in the case of the casting mold according to the present invention, the metal are disposed on the multiple support portions and the molten metal is drawn through the multiple passageways, but the respective molten metal, which are melted and drawn into the mold cavity, are uniformly distributed in the mold cavity and solidified while uniformly coming into contact with one another, such that a non-uniform interface of a metal structure is not formed between the flows of molten metal, and an integrated metal structure may be formed.

Meanwhile, as a specific configuration according to the second aspect, the respective suction portions may be disposed to be spaced apart from the passageways on a plane of the mold cavity, and the respective suction portions may be disposed at equal distances from the adjacent passageways.

With this configuration, the flows of the molten metal introduced into the mold cavity from the passageways do not come into direct contact with the suction portions but form flows toward the suction portions adjacent to the passageways, and particularly, the suction portions are disposed at equal distances from the passageways, such that the flows of the molten metal toward the respective suction portions may be more uniform.

In the casting mold according to the second aspect, the suction portion may be concavely formed downward from the second surface of the mold cavity, a suction hole, which communicates with the vacuum source, may be formed in a bottom surface of the suction portion, the blocking member may be formed in a shape complementary to the suction portion, an upper surface of the blocking member may be placed on the suction portion so as to define a part of the second surface of the mold cavity, and an air flow passageway from the mold cavity to the suction hole may be formed between the blocking member and the suction portion.

According to the aforementioned configuration, as the blocking members are placed on the suction portions, respectively, air, which is suctioned from the bottom surface of the suction portion, is suctioned through the air flow passageway between the blocking member and the suction portion, such that negative pressure is applied to the mold cavity.

In particular, since the blocking member having the aforementioned configuration may be replaced after being used once or a predetermined number of times, the blocking member may be replaced only by lifting up and removing the blocking member from the suction portion and then placing a new blocking member on the suction portion in the case in which the molten metal is solidified in and coupled to the blocking member.

Meanwhile, the air flow passageway between the blocking member and the suction portion may be formed only by adjusting surface roughness of any one of a portion of the suction portion and a portion of the blocking member which are in contact with each other.

Meanwhile, in the case in which the casting mold is used to manufacture an amorphous alloy, the molten metal needs to be rapidly cooled after the molten metal is introduced into the mold cavity and fills the mold cavity, and a coolant passageway for cooling the molten metal may be formed in the casting mold in order to rapidly cool the molten metal.

In contrast, in the case of the casting mold having the configuration according to the first aspect of the present invention and in the case in which the casting mold is configured to rapidly cool the molten metal, the metal, which is placed on the support portion and melted, or the molten metal placed on the support portion is introduced into the mold cavity through the passageway when the negative pressure is applied to the mold cavity, and in this case, there is concern that crystals will be formed as the molten metal is cooled by heat transfer to the upper mold while the molten metal passes through the passageway.

Therefore, as an additional configuration of the present invention, a thermal insulator or a thermal insulation coating may be provided in the passageway of the upper mold.

With the thermal insulator or the thermal insulation coating, a temperature drop of the molten metal, which is introduced from the support portion and passes through the passageway, may be minimized, such that the molten metal may be introduced into the mold cavity in a state in which the melted state is maintained and no crystal is formed.

BRIEF DESCRIPTION OF DRAWINGS

FIGS. 4 to 7 are views of a casting mold according to a first embodiment of the present invention, in which FIGS. 4 and 7 are longitudinal sectional views of the casting mold, and FIGS. 5 and 6 are perspective views illustrating a lower mold and a state in which a ring is mounted in the lower mold.

BEST MODE

Hereinafter, a configuration of a casting mold according to embodiments of the present invention and a casting process using the casting mold will be described with reference to the accompanying drawings.

First, a first embodiment will be described with reference to FIGS. 4 to 7.

Figure 1:
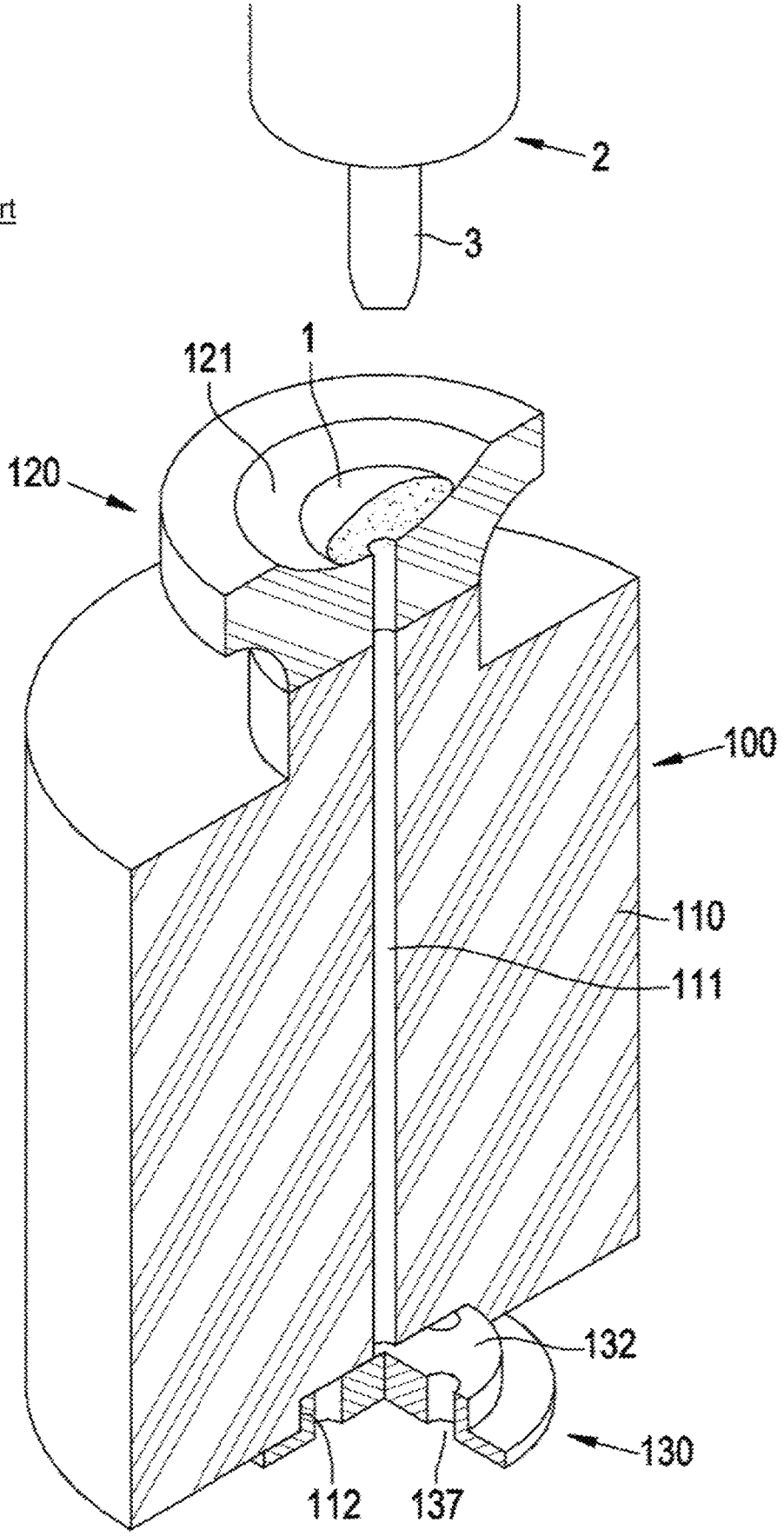
FIG. 1 Prior Art
FIGS. 1 and 3 are cross-sectional views of a differential pressure type casting mold in the related art.
Figure 2:
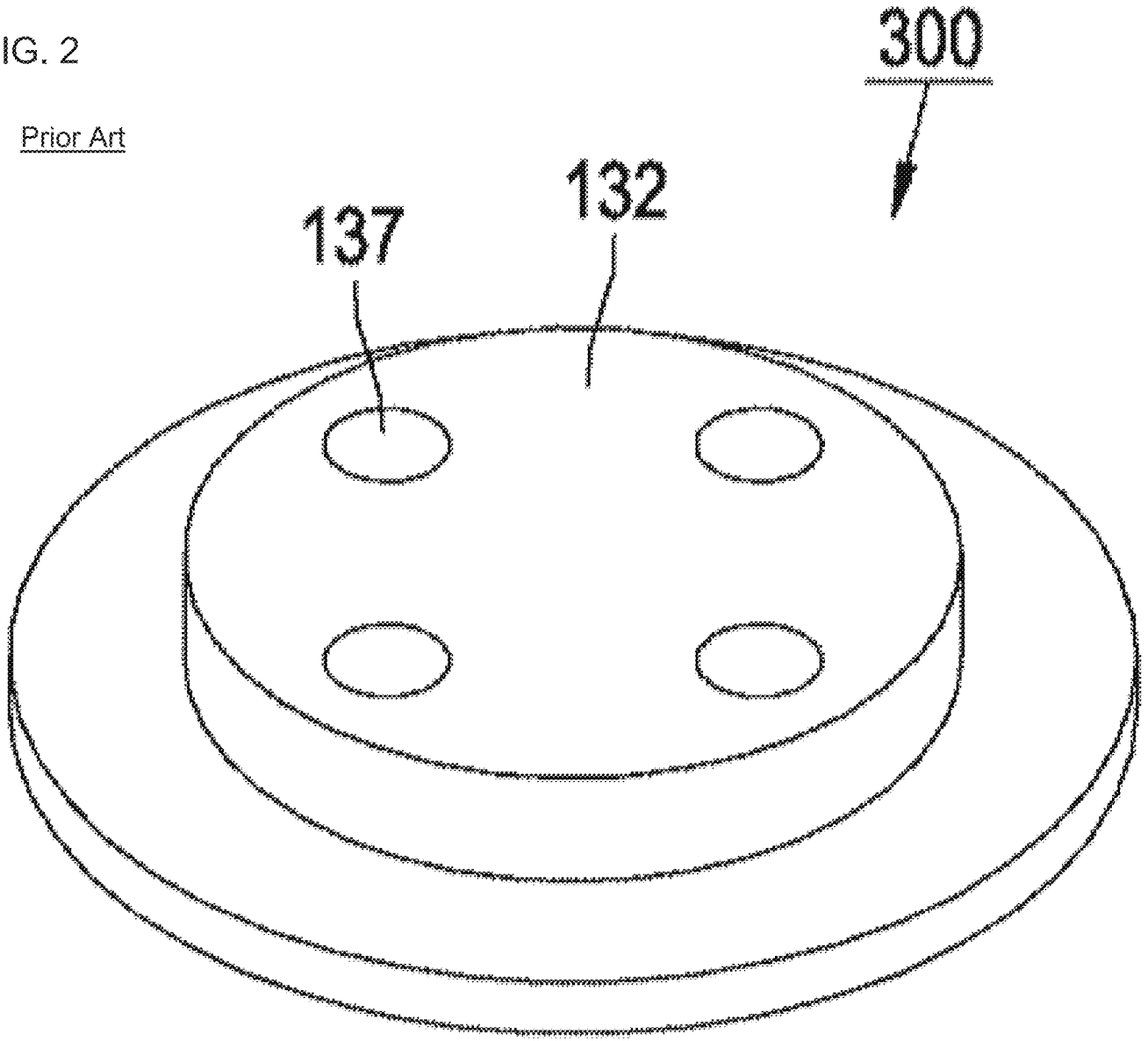
FIG. 2 Prior Art
FIG. 2 is a perspective view of a stopper of the differential pressure type casting mold in the related art illustrated in FIG. 1.
Figure 3:
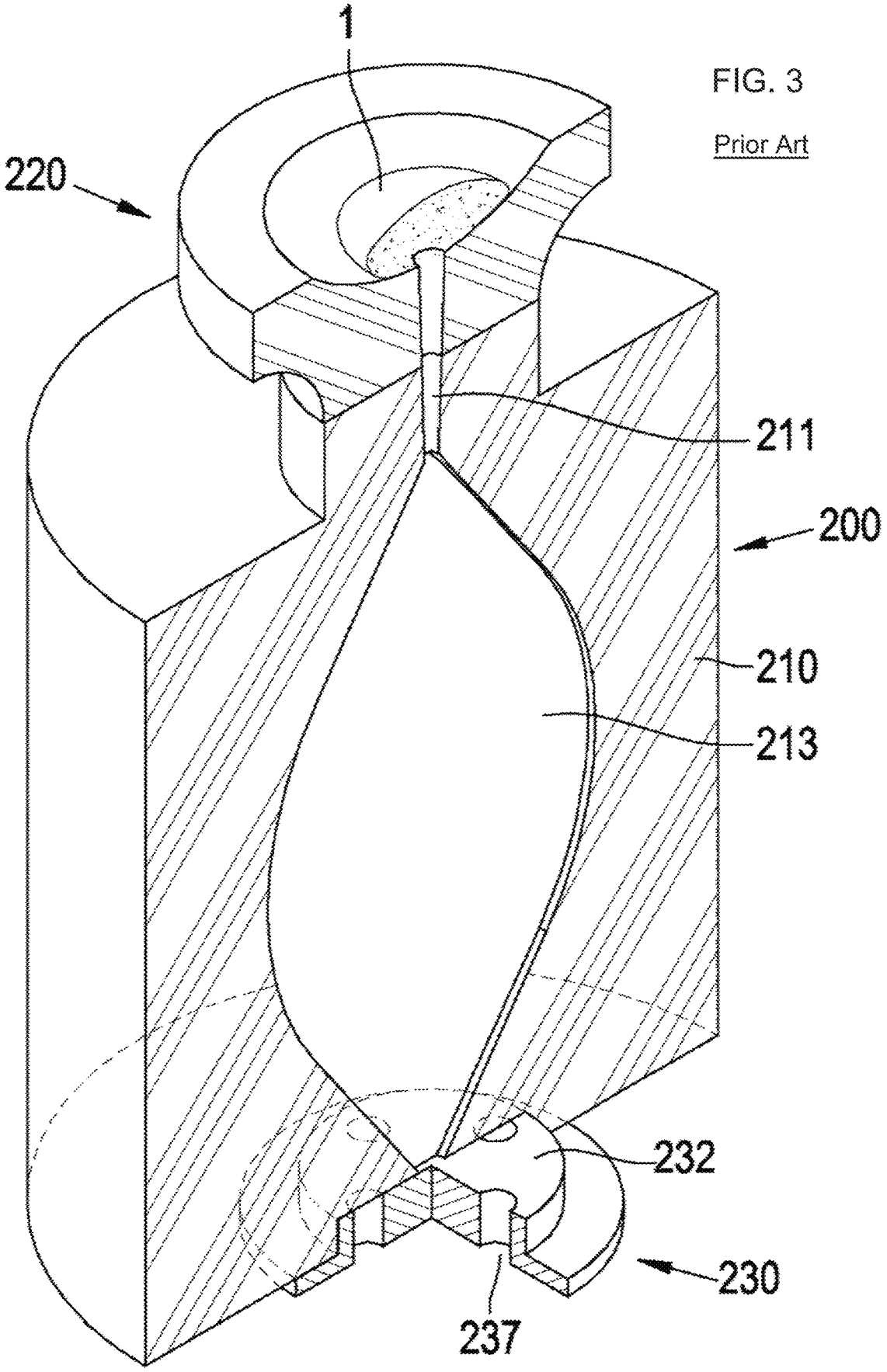
FIG. 3 Prior Art
Figure 4:
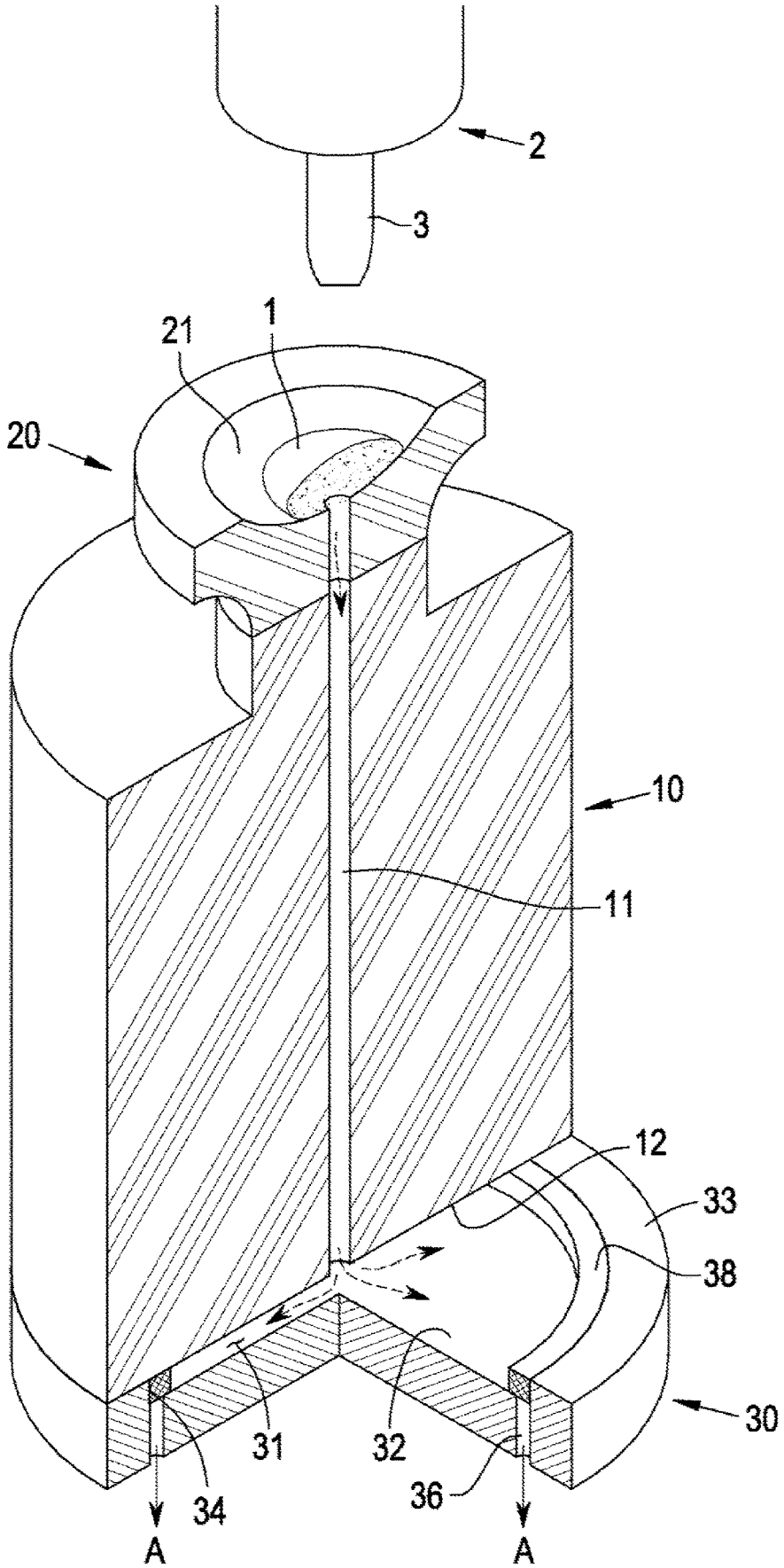

Referring to FIG. 4, a casting mold according to the first embodiment includes a loading member 20 which defines an uppermost portion of the casting mold and has a support portion 21 on which a solid metal 1, which will be a material for a metal sheet to be casted, is placed from above, an upper mold 10 which defines a mold cavity 31 together with a lower mold 30 and has a passageway 11 through which molten metal is drawn and flows from the loading member 20 to the mold cavity 31, and the lower mold 30 which defines the mold cavity together with the upper mold and has a suction portion 36 connected to a vacuum suction source (not illustrated) that applies negative pressure to the mold cavity 31.

The support portion 21 of the loading member 20, which has an upper end on which the metal 1 to be melted is placed, is provided in the form of a concave groove having an approximately hemispheric shape, and a heating device 2 having an arc electrode 3 is provided above the loading member 20 to melt the metal 1 by using an electric arc. Other heating sources such as a halogen lamp may be disposed instead of the arc electrode 3.

The upper mold 10 is formed in a cylindrical shape, and the passageway 11 is penetratively formed in the upper mold 10 vertically from a lower end of the support portion 21 of the loading member 20 to a lower end surface 12 of the upper mold 10. A cooling means (not illustrated), which allows a fluid for cooling the casting mold to circulate, may be disposed as necessary around the upper mold 10 and the lower mold 30.

An upper end surface 33 of the lower mold 30 is in contact with the lower end surface 12 of the upper mold.

The lower mold 30 is formed in a cylindrical shape similar to the upper mold, and has a bottom surface 32 which is spaced downward apart from the upper end surface 33 by a predetermined depth and is in parallel with the upper end surface 33, and a circumferential surface 34 which surrounds the bottom surface 32, thereby defining the mold cavity 31 together with the lower end surface 12 of the upper mold that faces the lower mold. The bottom surface 32 of the lower mold defines a second surface of the mold cavity, and the lower end surface 12 of the upper mold, which faces the bottom surface 32 of the lower mold, defines a first surface of the mold cavity.

The bottom surface 32 of the lower mold is formed in a circular shape, such that the lower end surface 12 of the upper mold, which defines the mold cavity 31 while facing the bottom surface 32 of the lower mold, also has a circular shape. The passageway 11 of the upper mold is disposed to be placed at a center of the circular shape.

In the present embodiment, each of the upper mold 10 and the lower mold 30 is formed in a cylindrical shape, but the shapes of the upper mold 10 and the lower mold 30 are not limited to the cylindrical shape, and the upper mold 10 and the lower mold 30 may have various shapes including a quadrangular cross section or an elliptical cross section.

In addition, in the present embodiment, the single passageway 11 of the upper mold is formed at a center of the upper mold 10, but the number of passageways and the positions of the passageways may be determined in accordance with a size, a shape, or the like of the mold cavity 31.

Figure 5:
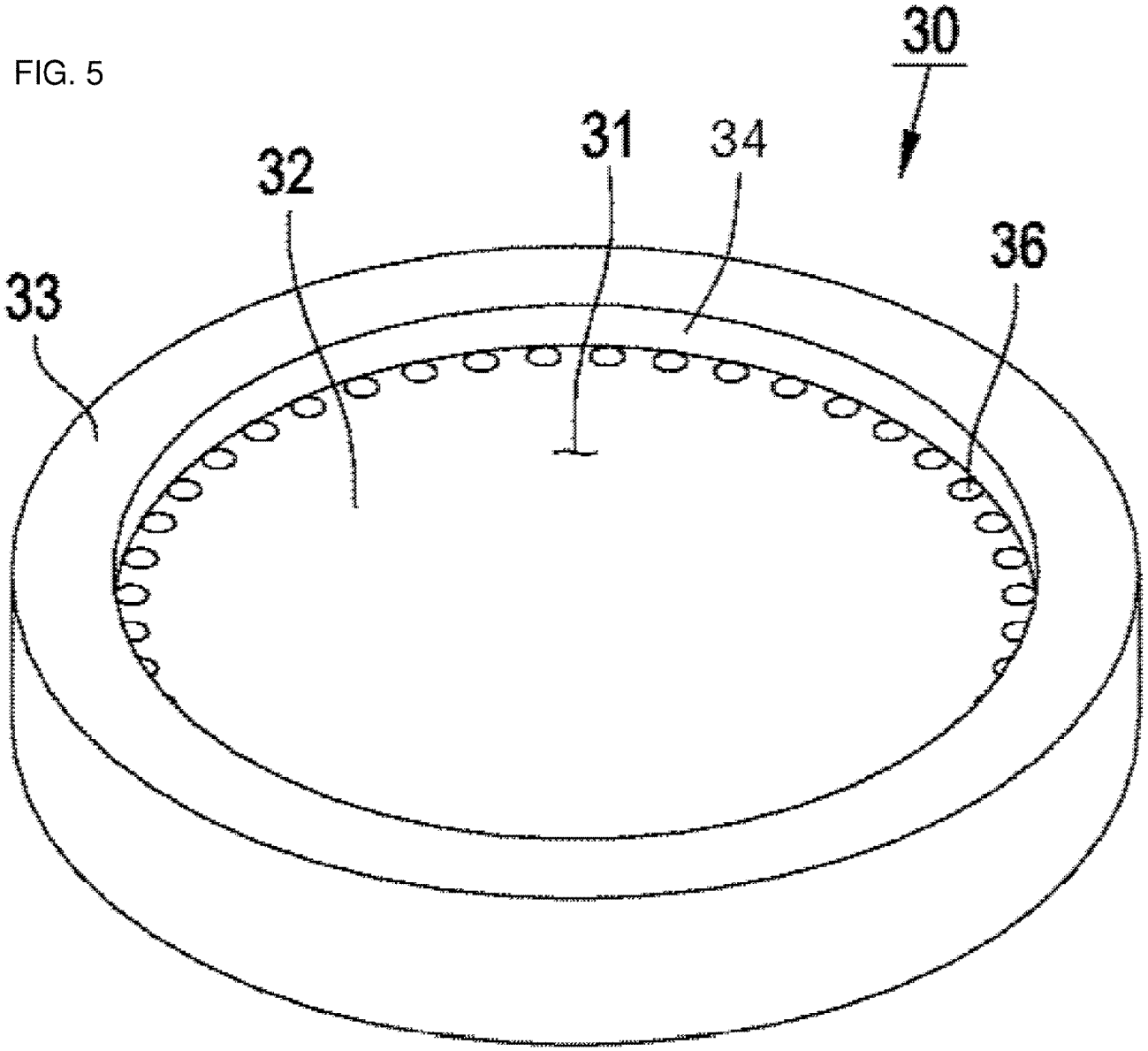

FIG. 5 is a perspective view illustrating only the lower mold 30, and referring to FIG. 5, multiple suction portions 36 each having a circular cross section are disposed around the bottom surface 32 of the lower mold in the vicinity of the circumferential surface 34 and extend to a lower end surface of the lower mold. The non-illustrated vacuum suction source is connected to the suction portions 36, such that negative pressure is applied to the mold cavity 31 as air is suctioned through the suction portions 36.

Meanwhile, the cross section of the suction portion 36 need not necessarily have a circular shape, and the shape and the size of the suction portion 36, the number of suction portions 36, the arrangement of the suction portions 36, and the like may be determined in accordance with a size, a shape, and the like of the mold cavity.

Figure 6:
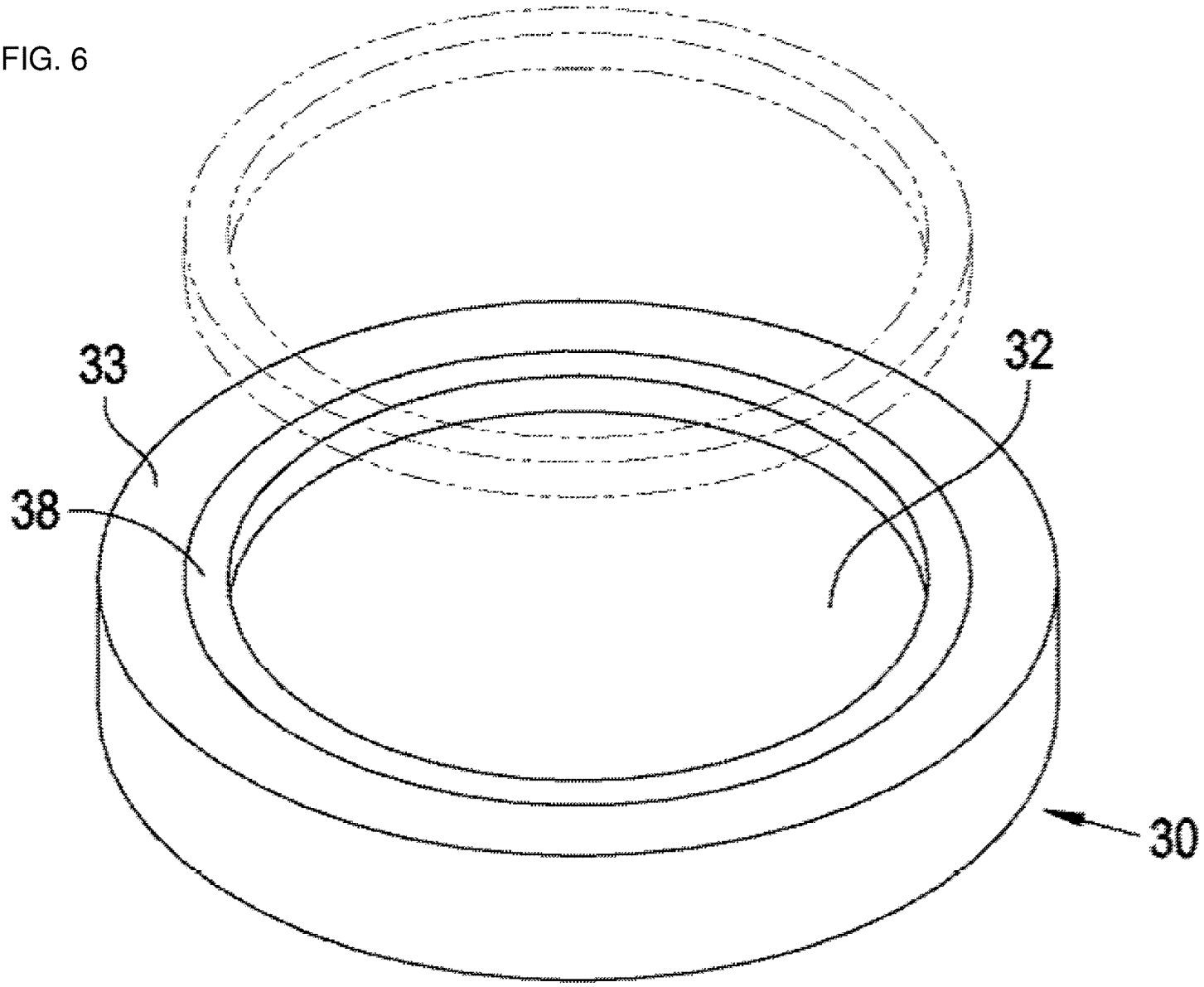

Referring to FIGS. 4 and 6, a blocking ring 38 is disposed around the mold cavity 31, the blocking ring 38 has a quadrangular cross section, an outer circumferential surface of the blocking ring 38 is in contact with the circumferential surface 34 of the mold cavity, and upper and lower surfaces of the blocking ring 38 are in contact with the lower end surface 12 of the upper mold and the bottom surface 32 of the lower mold, respectively, which define the mold cavity.

The blocking ring 38 is provided as a blocking member, and the lower surface of the blocking ring 38 is in contact with a circumference of the bottom surface 32 of the lower mold 30 where the suction portions 36 are formed, but the lower surface of the blocking ring 38 is just in a primarily machined state but not precisely polished and machined during the manufacturing process, such that grooves formed by coarse machining remains on the lower surface of the blocking ring 38, and as a result, the lower surface of the blocking ring 38 has surface roughness to the extent of allowing an air flow between the lower surface of the blocking ring 38 and the bottom surface 32 of the lower mold 30 even though the lower surface of the blocking ring 38 is in contact with the bottom surface 32 of the lower mold 30.

A process of casting a metal sheet by using the casting mold according to the first embodiment configured as described above will be described.

To cast the metal sheet, the solid metal 1 is disposed on the support portion 21 of a loading member, and a high-temperature electric arc is generated by applying electric power to the arc electrode 3 of the heater 2. When the metal 1 placed on the support portion 21 is heated and melted by the high-temperature electric arc, the vacuum suction source operates to load the molten metal into the mold cavity 31.

Negative pressure generated by the air suction by the vacuum suction source (not illustrated) is applied to the lower end of the support portion 21 through the suction portions 36, the mold cavity 31, and the passageway 11, and the molten metal is introduced into the mold cavity 31 through the passageway 11 by the negative pressure as indicated by the arrows in FIG. 4.

The molten metal is introduced from the passageway 11 positioned at the center of the first surface of the mold cavity 31 and flows between the first surface and the second surface, thereby forming a radial flow toward the circumference of the mold cavity 31 by the negative pressure from the suction portions 36 positioned around the mold cavity 31, and the molten metal fills the mold cavity 31 from the circumference of the mold cavity 31 as the molten metal is blocked by the blocking ring 38 disposed on the suction portion 36.

Each of the upper mold 10 and the lower mold 30, which define the mold cavity 31, is formed to have a large volume and made of copper or a copper alloy having a large heat capacity and high thermal conductivity, and a cooling fluid circulates around the molds, such that the molten metal, which fills the mold cavity 31, is rapidly cooled, solidified, and hardened before metal elements form crystal structures, thereby forming a casted product made of an amorphous metal.

Figure 7:
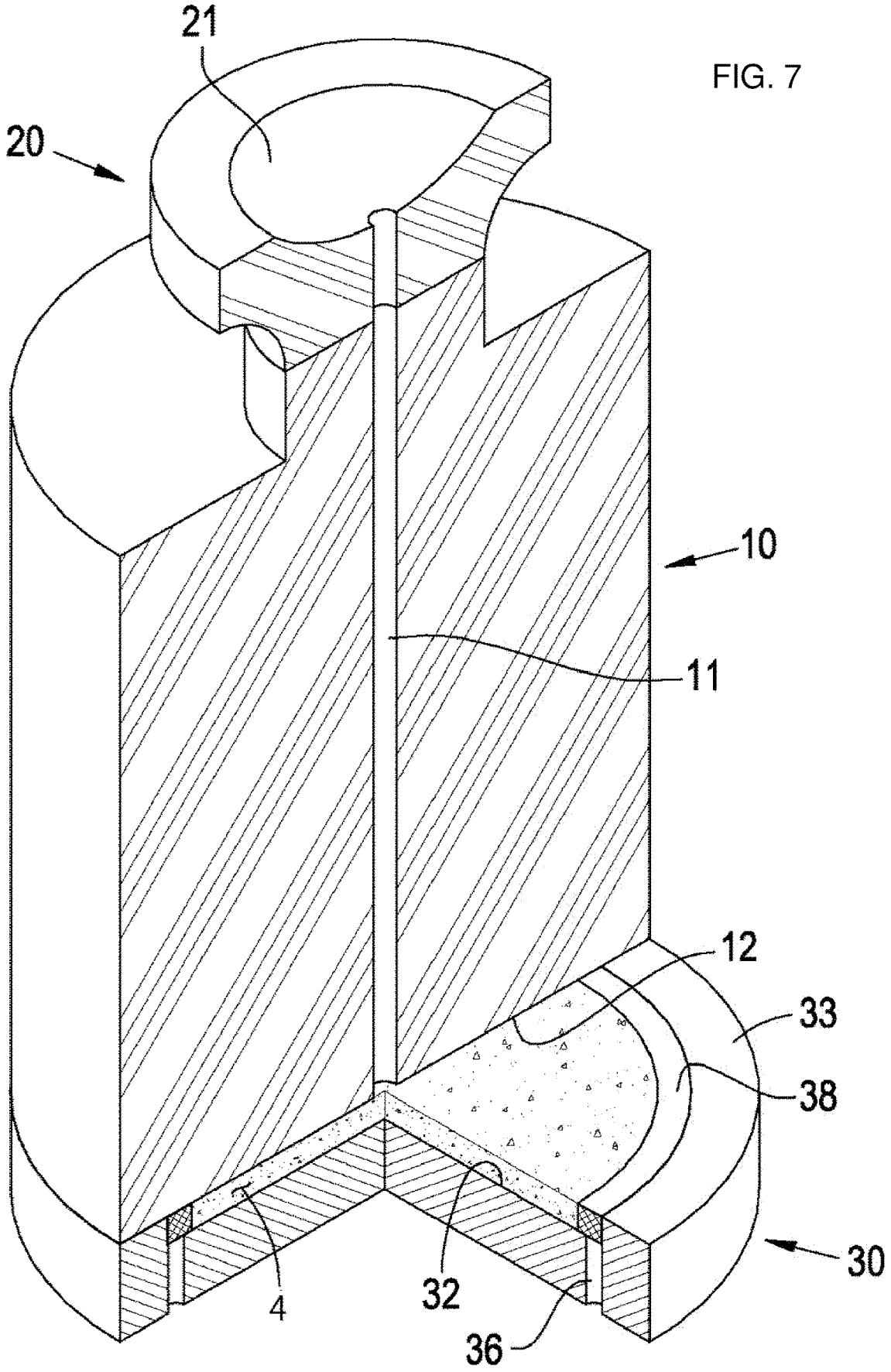
Figure 8:
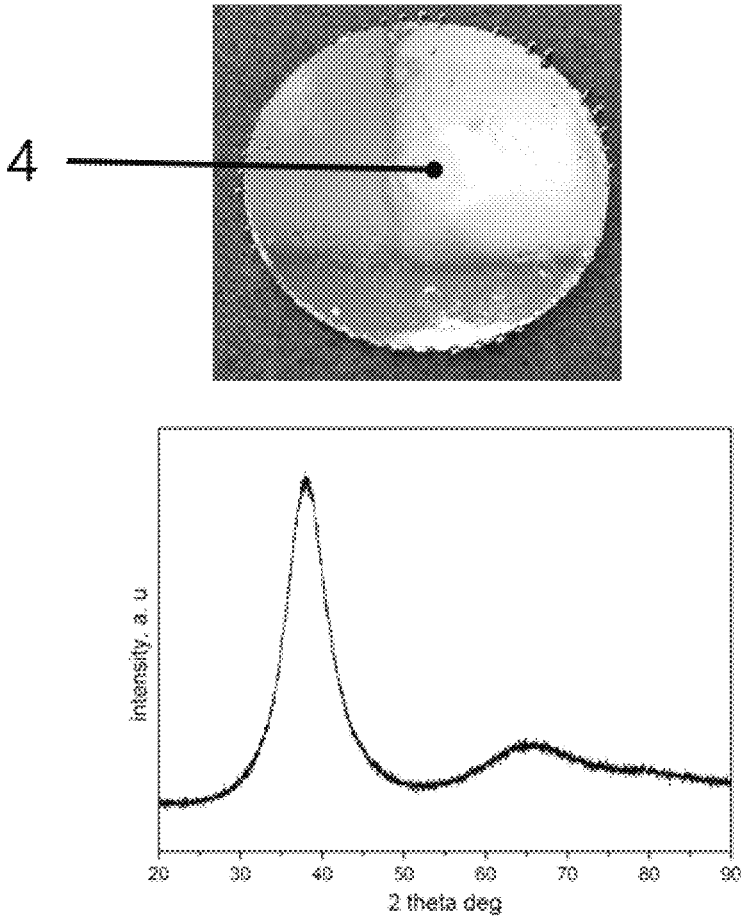
FIGS. 8 and 9 are photographs of a prototype of a metal sheet casted by using the casting mold according to the first embodiment of the present invention, and a graph illustrating a result of measuring an X-ray diffraction pattern.

FIG. 7 illustrates a state in which the molten metal fills the mold cavity and is hardened in accordance with the aforementioned process, and FIG. 8 illustrates photographs of a casted product manufactured by a prototype of the casting mold according to the first embodiment.

The left photograph in FIG. 8 illustrates a state in which a casted product 4 is attached to the upper end surface 33 and the bottom surface 32 of the lower mold 30, and it can be seen that a bar-shaped portion 5, which is formed as the molten metal remains in the passageway 11, remains at an upper side of the casted product. The bar-shaped portion 5 is just formed because the product in the photograph is a prototype, but the bar-shaped portion 5 is not inevitably formed in the present invention, and it is easy to prevent the formation of the bar-shaped portion 5 by adjusting the amount of metal to be loaded.

The right photograph is a photograph illustrating a state in which the casted product is separated from the lower mold, and this photograph illustrates a state in which the blocking ring 38 is attached to a lower surface of the casted product.

A circular metal sheet having a smooth surface is obtained by separating the blocking ring 38, removing the bar-shaped portion, and polishing or machining and removing a somewhat rough surface typically formed in the casting process.

Figure 9:
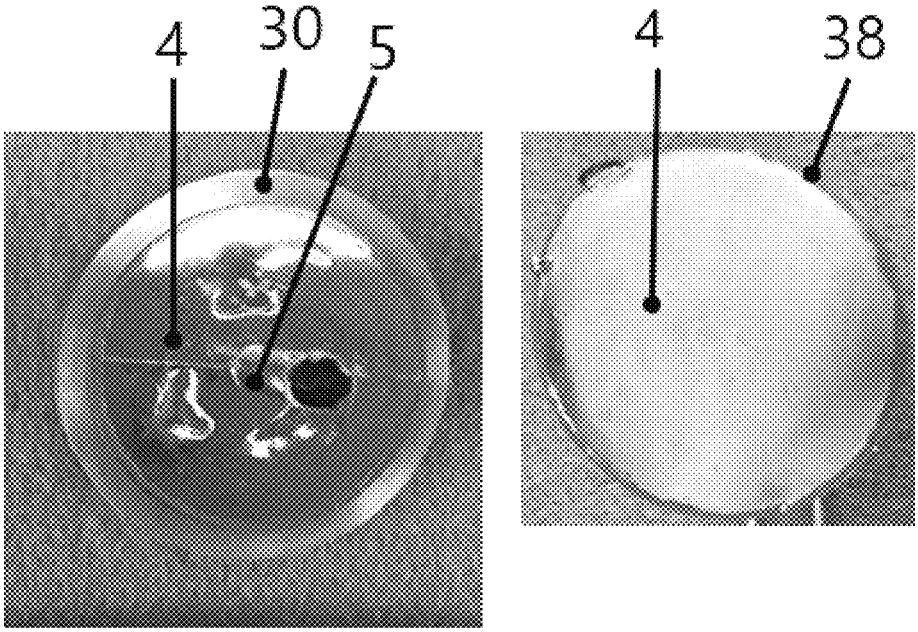

A photograph of the circular sheet obtained as described above is illustrated at the upper side of FIG. 9, and a result of an X-ray diffraction pattern test performed on the circular sheet obtained as described above is illustrated at the lower side of FIG. 9, and according to the result of this test, it can be seen that the circular sheet obtained by the casting using the casting mold according to the first embodiment is entirely formed in an amorphous manner.

Figure 10:
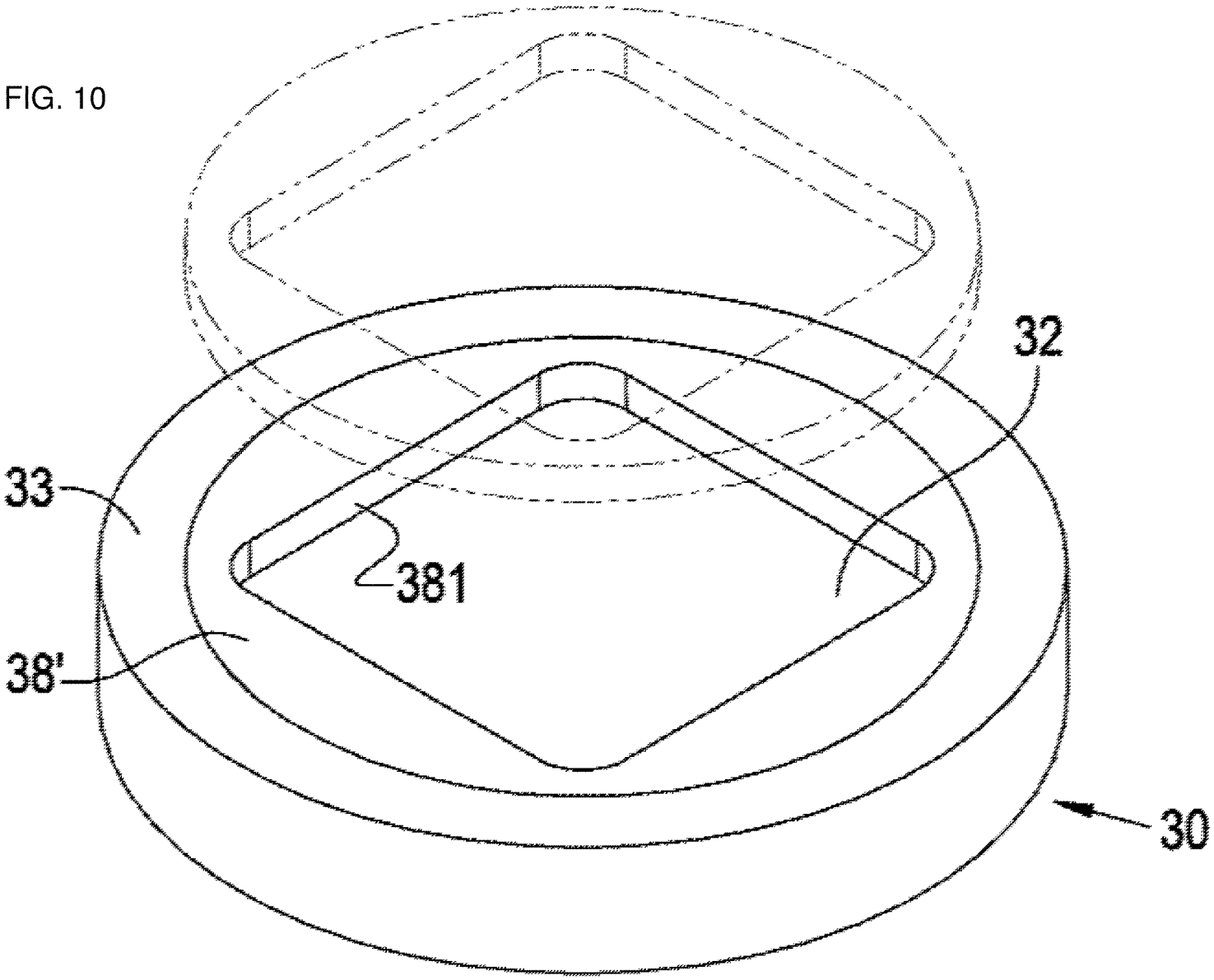
FIG. 10 is a perspective view of a modified example of the ring illustrated in FIG. 6.

FIG. 10 illustrates a modified example of the blocking ring of the casting mold according to the first embodiment.

In this modified example, the loading member 20, the upper mold 10, and the lower mold 30 are identical to those in the first embodiment, but only a shape of the circular blocking ring 38 according to the first embodiment is modified.

A blocking ring 38' is identical to the blocking ring 38 according to the first embodiment in that an outer circumferential surface of the blocking ring 38' is formed in a circular shape, but the blocking ring 38' differs from the blocking ring 38 according to the first embodiment in that an inner circumferential surface 381 of the blocking ring 38', which defines the circumferential surface of the mold cavity, is formed in a quadrangular shape.

The mold cavity 31 has a quadrangular shape in a plan view because of the inner circumferential surface 381 having a quadrangular shape, and with this blocking ring 38' having the configuration, it is possible to obtain a quadrangular metal sheet.

As described above, in the first embodiment of the present invention, various shapes of the inner circumferential surface of the blocking ring may be selected, and as a result, it is possible to cast metal sheets having various shapes only by changing the blocking rings without changing the configuration of the casting mold.

Figure 11:
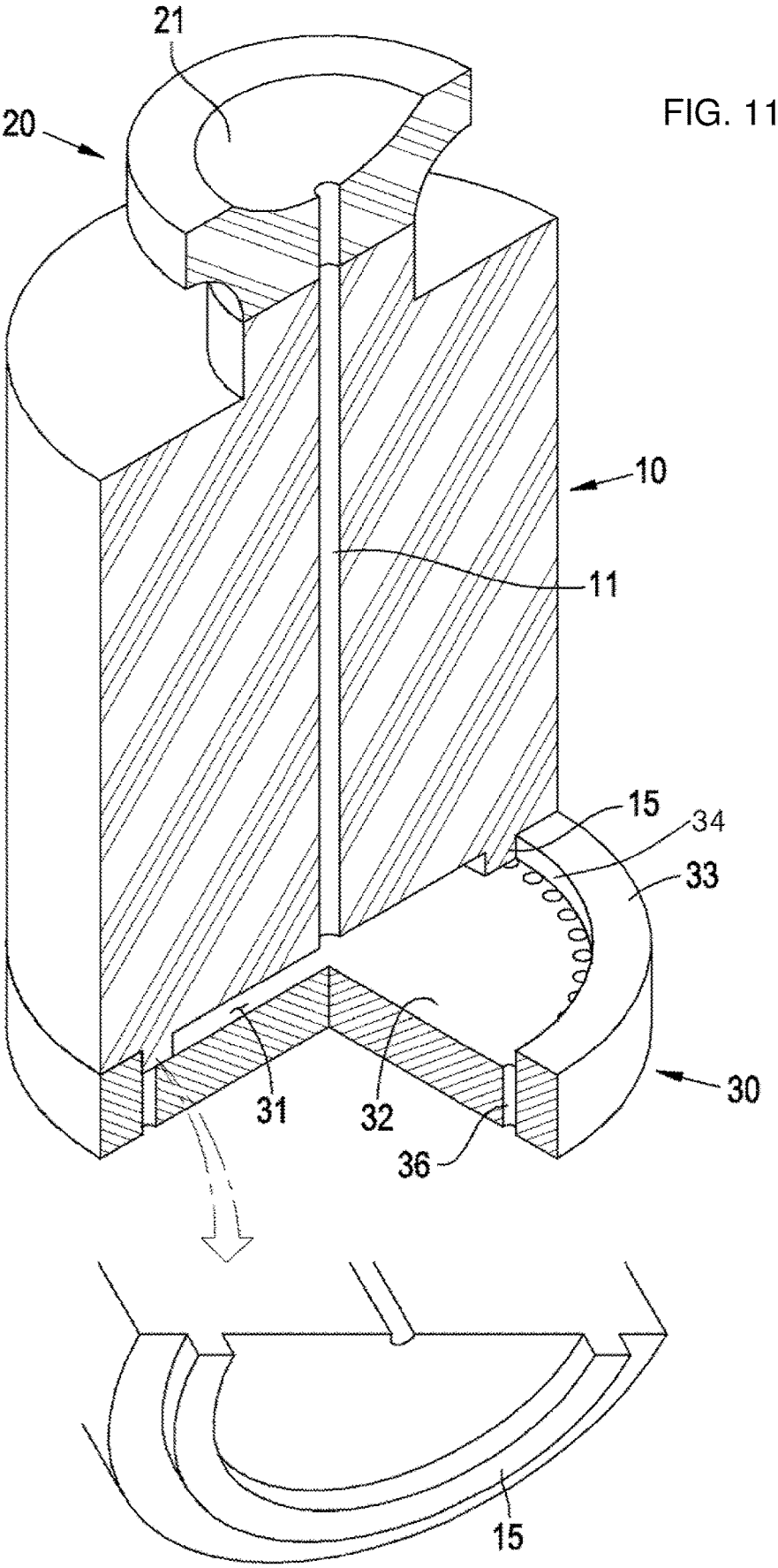
FIG. 11 is a cross-sectional view of a casting mold according to a second embodiment of the present invention.

Next, a configuration of a second embodiment of the present invention will be described with reference to FIG. 11.

Basic configurations of the loading member 20, the upper mold 10, and the lower mold 30 of the casting mold according to the second embodiment are also identical to those of the casting mold according to the first embodiment, but the second embodiment differs from the first embodiment in that a protruding portion 15, which protrudes downward from a lower end surface 12' of the upper mold, is formed instead of the blocking ring 38 according to the first embodiment.

Similar to the blocking ring 38 according to the first embodiment, the protruding portion 15 is configured to be disposed around the mold cavity 31. The protruding portion 15 also has a quadrangular cross section, an outer circumferential surface of the protruding portion 15 is in contact with the circumferential surface 34 of the mold cavity, and a lower surface of the protruding portion 15 is in contact with a portion of the bottom surface 32 of the lower mold which is adjacent to the circumferential surface 34 in which the suction portions 36 are formed.

Similar to the blocking ring 38, the protruding portion 15 is also provided as a blocking member of the present invention, a lower surface of the protruding portion 15 is in contact with the circumference of the bottom surface 32 of the lower mold 30 where the suction portions 36 are formed, but in in a primarily machined state during the manufacturing process, the lower surface of the protruding portion 15 has surface roughness to the extent of allowing an air flow between the lower surface of the protruding portion 15 and the bottom surface 32 of the lower mold.

Similar to the blocking ring, it is possible to obtain metal sheets having various planar shapes by variously forming shapes of the inner circumferential surface of the protruding portion 15.

Therefore, even in the case in which a metal sheet is casted by using the casting mold according to the second embodiment, suction is performed through the suction portions 36 from the mold cavity 31 by vacuum suction, but molten metal, which is introduced into the mold cavity 31 while filling the mold cavity 31, does not leak to the suction portions 36.

Figure 12:
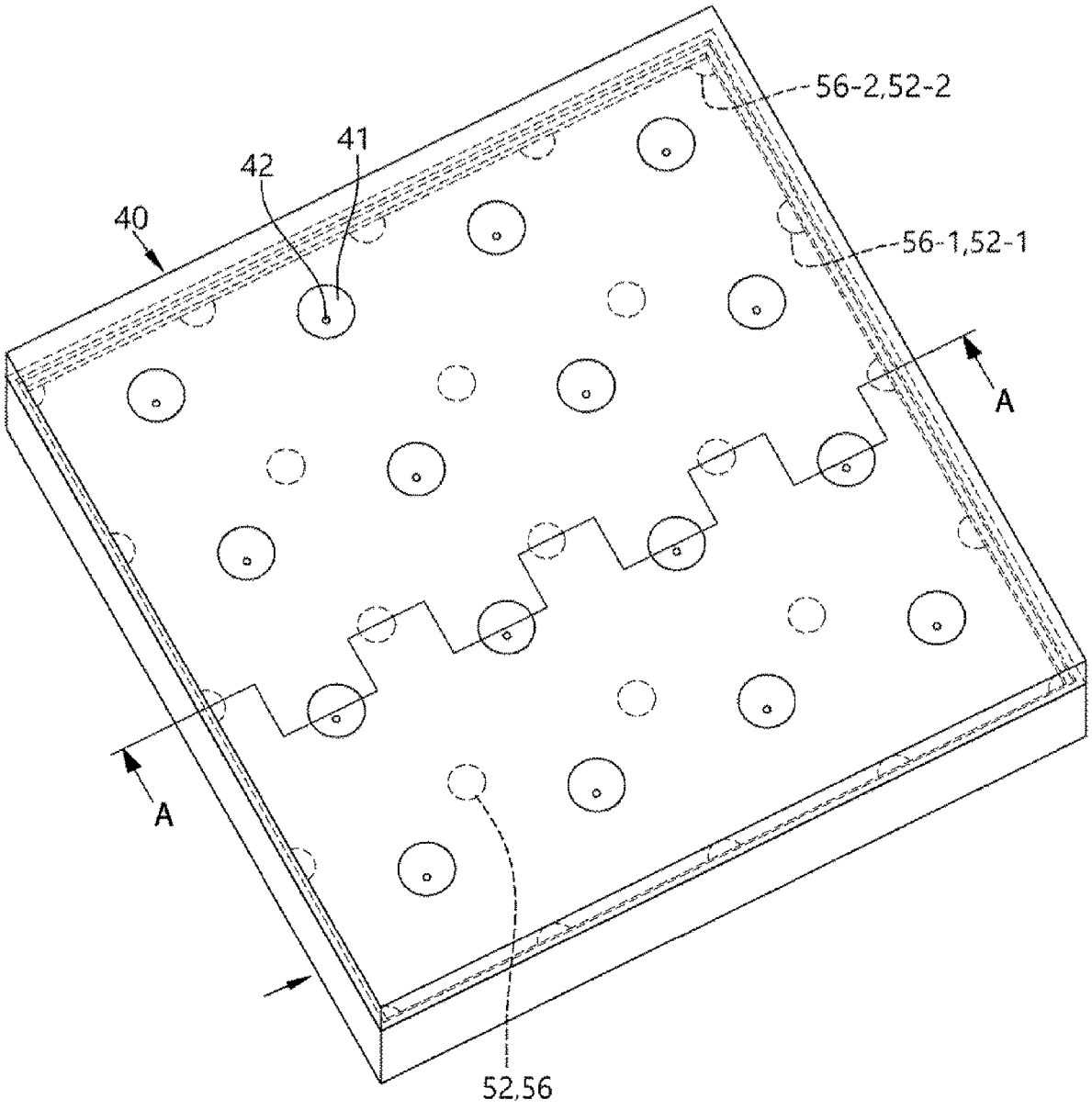
FIG. 12 is a perspective view of a casting mold according to a third embodiment of the present invention.
Figure 13:
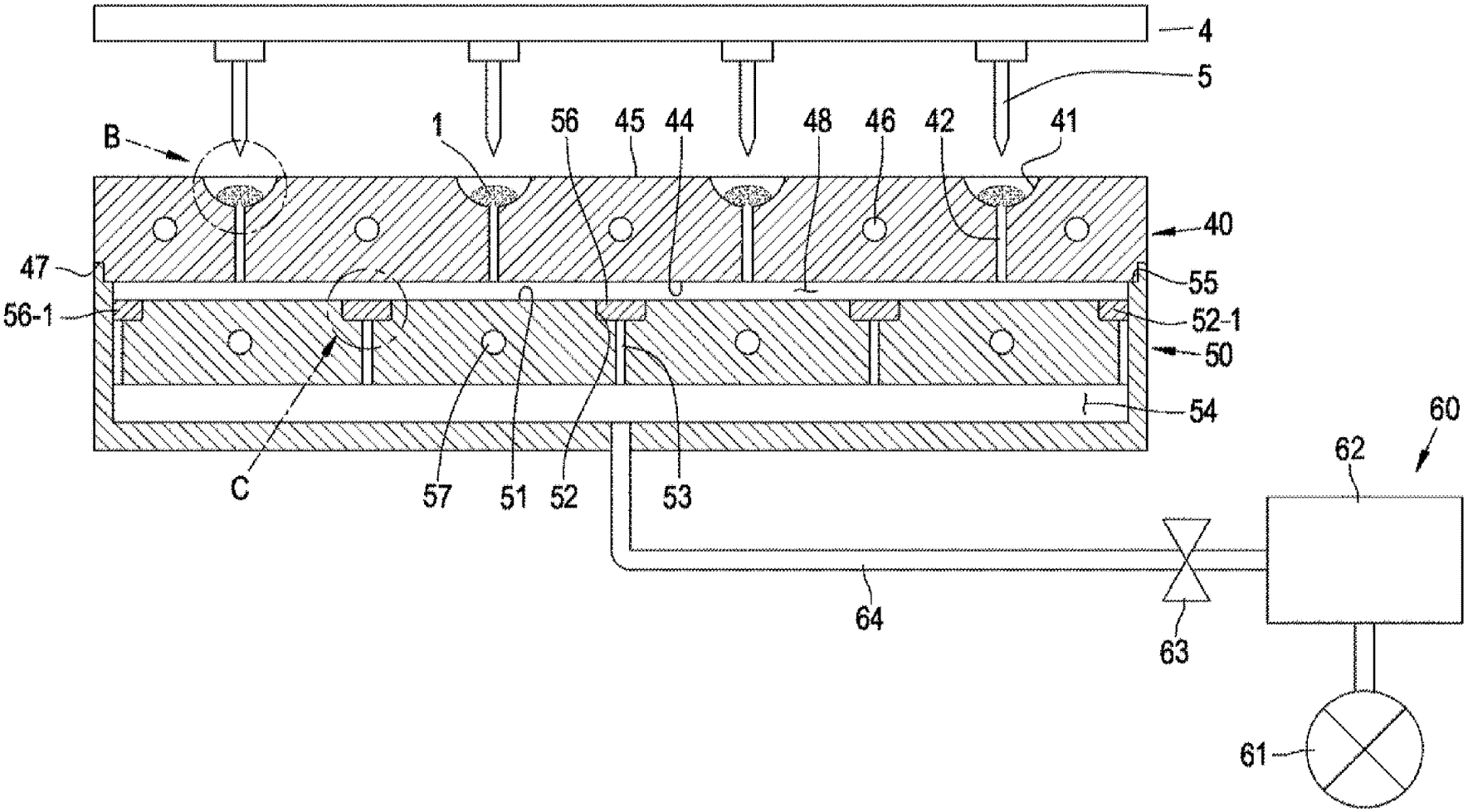
FIG. 13 is a longitudinal sectional view taken along line A-A in FIG. 12.

Next, a casting mold according to a third embodiment of the present invention and configurations of peripheral devices of the casting mold will be described with reference to FIGS. 12 and 13. FIG. 12 illustrates a perspective view of the casting mold according to the third embodiment, and FIG. 13 is a longitudinal sectional view of the casting mold and further illustrates a heating device 4 and a vacuum suction device 60.

The casting mold according to the third embodiment includes an upper mold 40 and a lower mold 50 which each have a block shape. A stepped portion 47 is formed around a lower surface 44 of the upper mold 40, and a stepped portion 55, which engages with the stepped portion 47 of the upper mold, is formed around an upper surface 51 of the lower mold 50, such that a mold cavity 48, which is defined between the lower surface 44 of the upper mold 40 and the upper surface 51 of the lower mold 50, is sealed during the casting process.

Each of the lower surface 44 of the upper mold 40 and the upper surface 51 of the lower mold 50 is formed as a flat surface so as to define a first surface and a second surface of the mold cavity 48 and thus has a shape corresponding to a shape of a metal sheet to be manufactured by the casting mold.

Multiple support portions 41, on which solid metal 1, which are materials of the metal sheet to be casted, are placed, are formed on an upper surface 45 of the upper mold 40. The support portion 41 is formed in a hemispheric shape concavely recessed from the upper surface 45, and the multiple support portions 41 are arranged in the form of a matrix at equal intervals on a plane.

The heating device 4 having multiple arc electrodes 5 is disposed above the upper mold 10, and each of the arc electrodes 5 is placed above each of the support portions 41 and melts the metal placed on the support portion 41.

Passageways 42, which extend vertically from bottom surfaces of the support portions 41 to the mold cavity 48, are formed in the upper mold 40. When negative pressure is applied to the mold cavity 48, the negative pressure is applied to the support portion 41 through the passageway 42, and the negative pressure is applied from the mold cavity 48 in a state in which the metal 1 placed on the support portion 41 is melted, such that the molten metal is introduced into the mold cavity 48 through the passageway 42.

Meanwhile, in the third embodiment, the support portion 41 on which the metal 1 is placed and melted is formed on the upper surface 41 of the upper mold 40, and, similar to the first embodiment, an element having a single support portion may be formed separately from the upper mold 40, and the element may be fixed to the upper surface of the upper mold and may be replaced as necessary.

Figure 14:
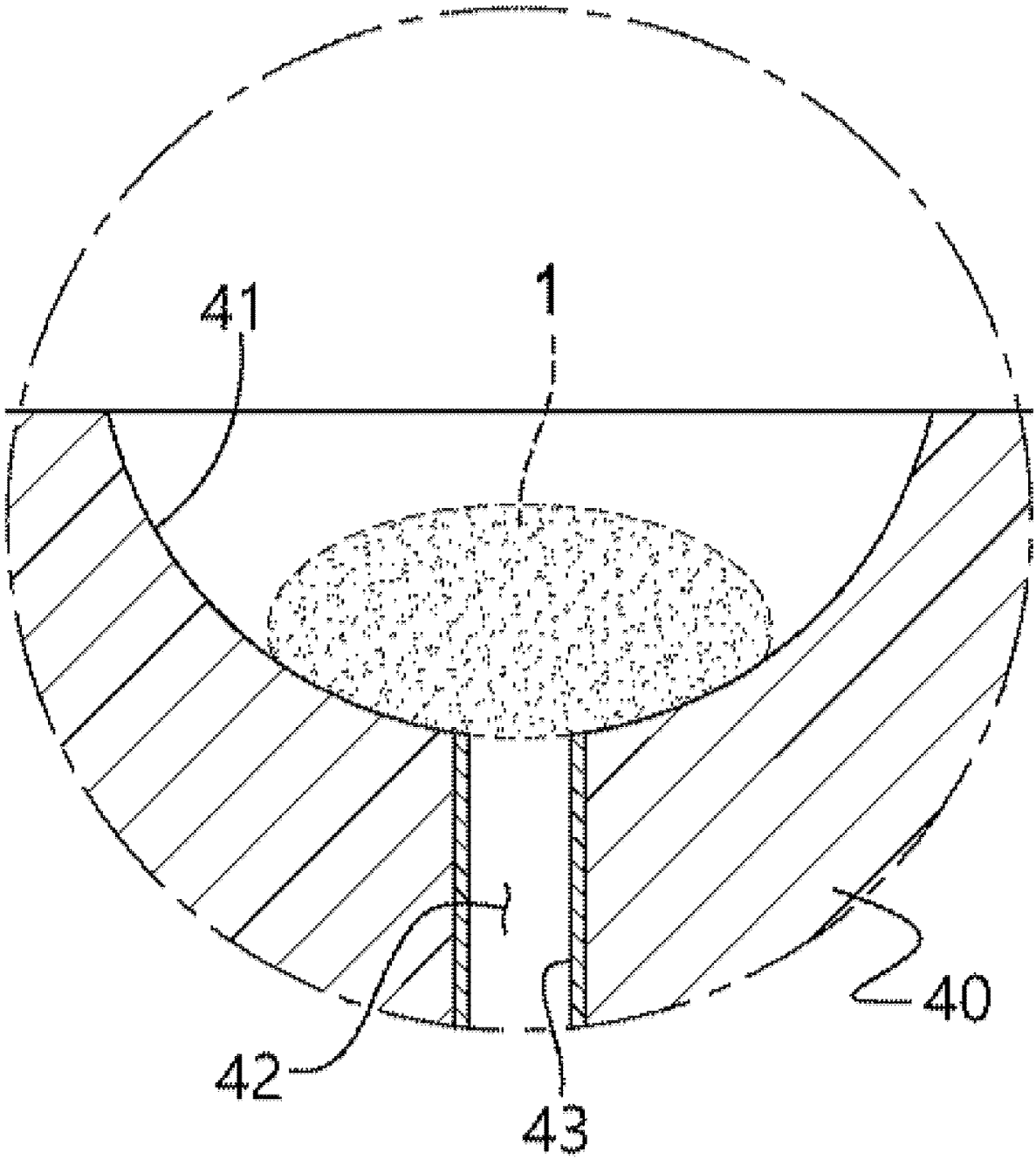
FIG. 14 is an enlarged view of part 'B' in FIG. 13.

Referring to FIG. 14 which illustrates an enlarged view of part 'B' in FIG. 13, a ceramic coating 43 having a high thermal insulation property is formed on an inner surface of the passageway 42. When the metal 1 is melted and flows through the passageway 42, a loss of heat to the upper mold 40 is minimized by the ceramic coating 43.

In addition to the ceramic coating 43, other materials, which have thermal insulation properties but are not damaged by or attached to the molten metal, may be formed as a coating on or attached to the passageway 42. As an example, a material may be used which has therein multiple pores to minimize heat transfer and has a surface smoothly processed to minimize resistance against a flow of the molten metal.

Multiple suction portions 52, 52-1, and 52-2, which are concavely processed downward from the upper surface 51 of the lower mold 50 which defines the second surface of the mold cavity 48, are formed, and blocking members 56, 56-1, and 56-2 are placed on the suction portions, respectively.

Suction holes 53, which extend downward, are formed in bottom surfaces of the suction portions, respectively, and a suction cavity 54 is formed at a lower side of the lower mold 50, such that each of the lower ends of the suction holes 53 communicates with the suction cavity 54. The suction cavity 54 communicates with the vacuum suction device 60 positioned outside the lower mold 50. The vacuum suction device 60 includes a vacuum pump 61, a reservoir 62, a valve 63, and a conduit 64 in this order, and the conduit 64 penetrates the lower mold 50 and communicates with the suction cavity 54.

In this configuration, when the valve 63 is opened, air is suctioned from the suction cavity 54 through the conduit 64 such that negative pressure is applied to the suction cavity 54, and the negative pressure is applied to the respective suction holes 53 connected to the suction cavity.

In this embodiment, since the suction cavity 54 is provided in the lower mold 50, uniform negative pressure is applied simultaneously to the respective suction holes 53 when air in the suction cavity 54 is suctioned by the operation of the vacuum suction device 60, but it is possible to apply uniform negative pressure simultaneously to the respective suction holes 53 by connecting the respective suction holes 53 to the vacuum suction device 60 and equally adjusting distances from the valve 63 of the vacuum suction device to the suction holes 53 without providing the suction cavity 54.

The three types of suction portions 52, 52-1, and 52-2 are provided, and referring to FIG. 12, the suction portions 52 placed inside the lower mold 50 each have a circular shape, the suction portions 52-1 placed around the lower mold 50 each have a semi-circular shape, and the suction portions 52-2 placed at corners of the lower mold 50 each have an arc shape having an arc angle of 90°.

The suction portions 52, 52-1, and 52-2 are disposed at positions spaced apart from the support portions 41 and the passageways 42 of the upper mold so that the suction portions 52, 52-1, and 52-2 are placed at equal distances in a plan view from centers of the support portions 41 and the passageways 42 of the upper mold. With this arrangement, the several suction portions 52, 52-1, and 52-2 surround the single passageway 42.

The suction hole 53, which extends downward, is formed in the bottom surface of each of the suction portions 52, 52-1, and 52-2, and each of the blocking members 56, 56-1, and 56-2, which is formed to have a shape complementary to a shape of each of the suction portions 52, 52-1, and 52-2, is placed on each of the suction portions.

Figure 15:
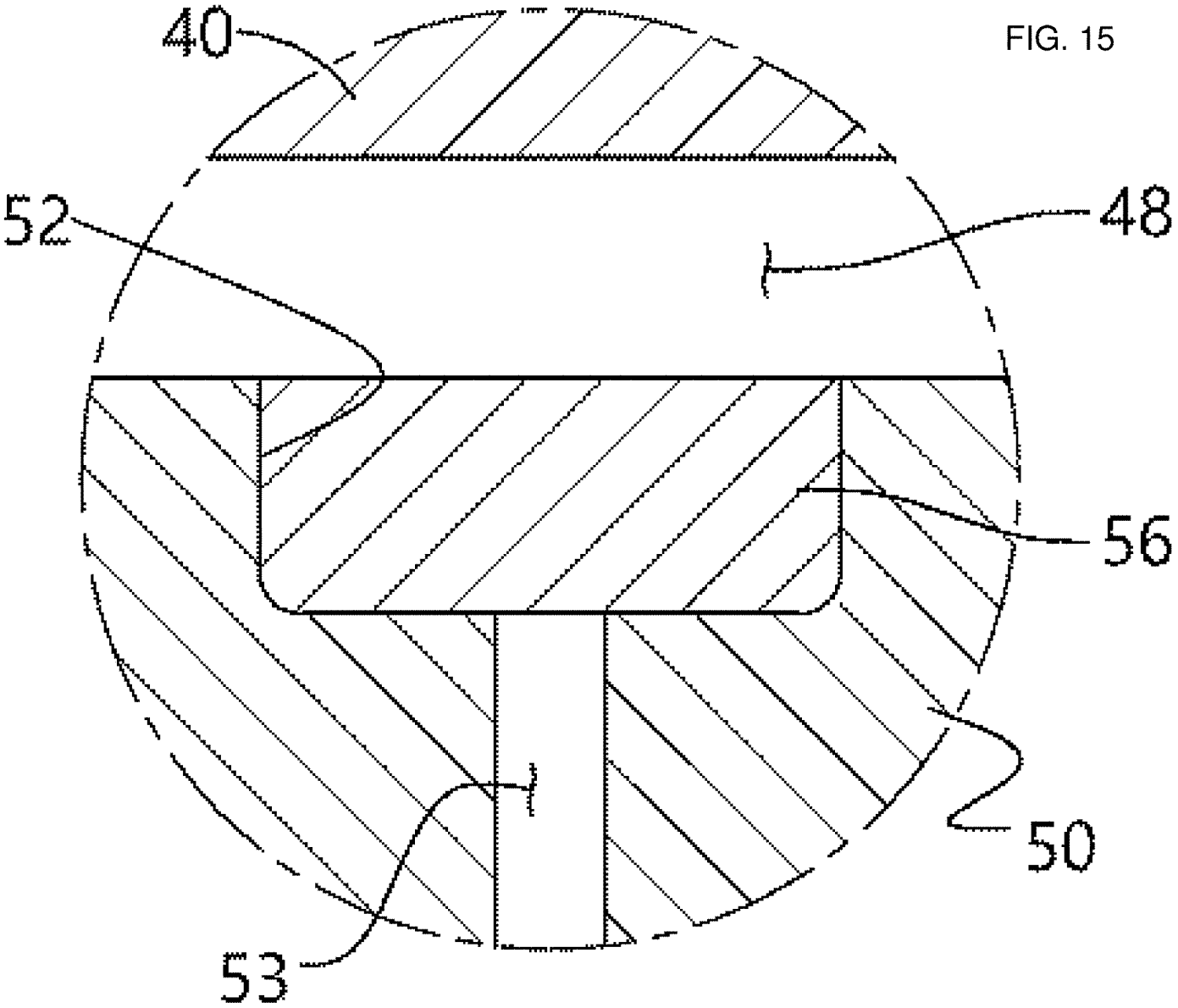
FIGS. 15 to 17 are enlarged views of part 'C' in FIG. 13 and illustrate various modified configurations.
Figure 16:
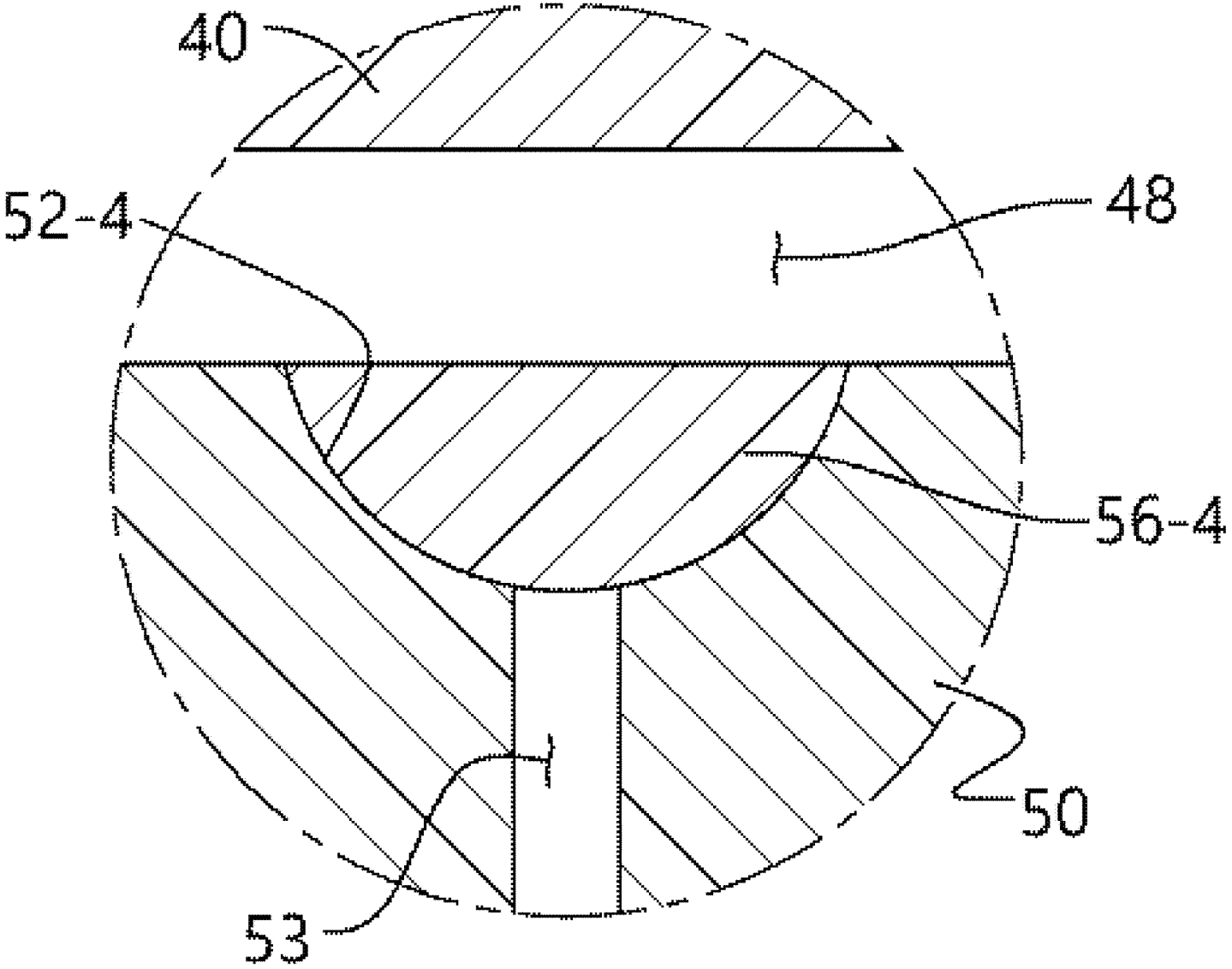
Figure 17:
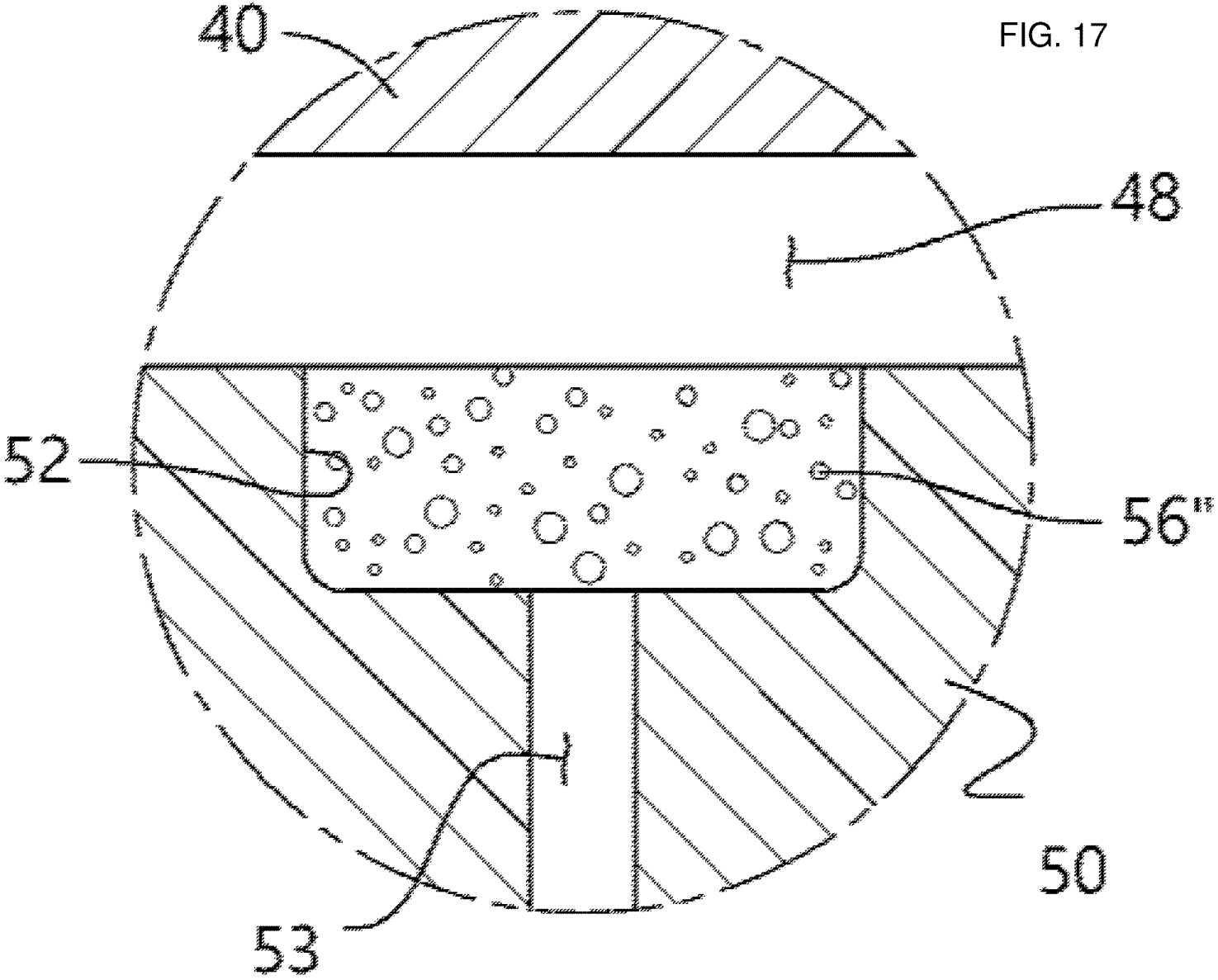

Referring to FIGS. 15 to 17 illustrating enlarged views of part 'C' in FIG. 13, each of the blocking members 56, 56-1, and 56-2 is placed on each of the suction portions 52, 52-1, and 52-2, and an upper surface of each of the blocking members 56, 56-1, and 56-2 serves as a part of the second surface of the mold cavity 48, such that each of the suction portions 52, 52-1, and 52-2 is closed, and the suction hole 53 below each of the suction portions is also closed, but each of the suction portions is not sealed by each of the blocking members 56, 56-1, and 56-2 even to the extent that air does not flow between the suction hole 53 and the mold cavity 48, that is, negative pressure from the suction cavity 54 is not applied to the mold cavity 48.

Each of the blocking members 56, 56-1, and 56-2 may be formed by machining, forging, or casting, the upper surface of each of the blocking members 56, 56-1, and 56-2, which defines the second surface of the mold cavity 48, is a smooth surface made by polishing similar to other surfaces of the mold cavity 48, but a surface of each of the blocking members 56, 56-1, and 56-2, which is in contact with each of the suction portions 52, 52-1, and 52-2, is maintained in a primarily machined state, such that air flow passageways, which enable air to flow therethrough but prevent the molten metal introduced into the mold cavity 48 from passing therethrough, are formed between each of the blocking members and each of the suction portions.

Likewise, each of the suction portions 52, 52-1, and 52-2 of the lower mold is processed just to the extent that each of the suction portions is in contact with each of the blocking members by removing only large protrusions or only very coarse surfaces that may be formed during the process of manufacturing the lower mold 50, such that air flow passageways are formed between each of the blocking members and each of the suction portions.

Meanwhile, the blocking member and the suction portion may be formed in the form of a coin like the shape in the third embodiment illustrated in FIG. 15, but as illustrated in FIG. 16, the blocking member and the suction portion may be formed in a hemispheric shape, such that the air flow passageway between the surface of the blocking member 56-4 and the surface of the suction portion 52-4, which are in contact with each other, is shorter than the air flow passageway in the shape illustrated in FIG. 15.

In addition, in a modified example illustrated in FIG. 17, a blocking member 56" and a suction portion 52 are formed to have the same shapes as those in the third embodiment, but a surface of the blocking member 56" and a surface of the suction portion 52 are in close contact with each other to the extent of disabling an air flow therebetween, but the blocking member 56" is made of a porous ceramic material, such that negative pressure applied from the suction hole 53 may be smoothly delivered to the mold cavity 48. A metal having fine through holes may also be used instead of the porous ceramic material.

The air flow passageways between the blocking members and the suction portions or the pores of the blocking members made of ceramic materials may be clogged by the molten metal while the casting mold is still used and the molten metal is drawn, and as a result, negative pressure may not be applied.

The blocking members are merely placed on the suction portions instead of being coupled and fixed to the suction portions, and as a result, the blocking members may be removed from the mold after being used several times, and the blocking members may be regenerated or replaced.

Figure 18:
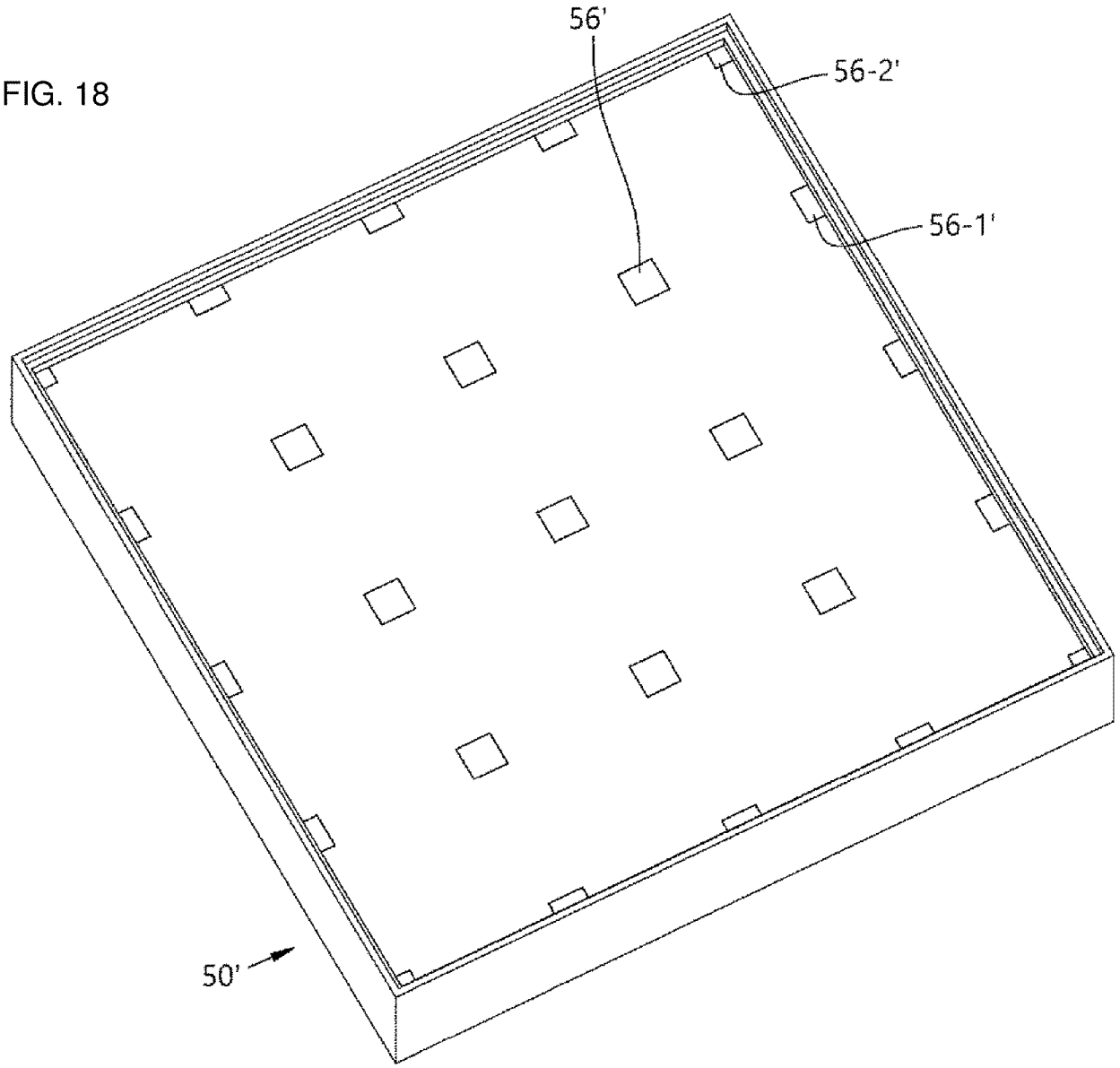
FIG. 18 is a perspective view of a casting mold according to a fourth embodiment of the present invention.

In the aforementioned embodiments, all of the blocking members and the suction portions are formed in a circular shape in a plan view, but the shapes of the blocking members and the suction portions are not limited thereto, and like blocking members 56', 56-1', and 56-2' of a casting mold according to a fourth embodiment illustrated in FIG. 18, the blocking members and the suction portions may be formed in an approximately quadrangular shape or in various shapes in order to allow air to be smoothly suctioned from the mold cavity and allow the molten metal to smoothly flow in the mold cavity, and the arrangements of the blocking members and the suction portions may be different from those illustrated in FIGS. 12 and 18.

For example, in the aforementioned embodiments, the blocking members and the suction portions are disposed in the form of a matrix, but the suction portions may be continuously provided, and several blocking members may be disposed on the suction portions.

Meanwhile, referring to FIG. 13, coolant passageways 46 and 57 are formed between the passageways 42 and between the suction holes 53 in the upper mold 40 and the lower mold 50, respectively. A coolant is circulated through the coolant passageway by a non-illustrated external coolant supply source.

When the molten metal is introduced into the mold cavity 48, the molten metal is cooled by the upper mold and the lower mold, but the casting mold is heated thereby. When a temperature of the casting mold is high, the molten metal is slowly cooled, such that crystals may grow during a process of solidifying the metal, but according to the casting mold of the present embodiment, since the coolant circulates through the coolant passageways 46 and 57, the temperature of the casting mold remains low even though the process of casting metal sheets is repeatedly performed, and as a result, the molten metal may be rapidly solidified.

Hereinafter, a process of casting a metal sheet by using the casting mold according to the third embodiment will be described.

To cast the metal sheet, the solid metal 1 are disposed on the support portions 41, respectively, and electric power is applied to the arc electrodes 3 of the heating device 2 to generate high-temperature electric arcs. When the metal 1 placed on the support portions 41 are heated and melted by the high-temperature electric arcs, the valve 63 of the vacuum suction device 60 is opened so that the molten metal is introduced into the mold cavity 48.

Negative pressure is applied as air is discharged from the suction cavity 54 in the lower mold 50 by air suction of the vacuum suction device 60, and air is suctioned from the respective suction portions 52, 52-1, and 52-2 through the suction holes 53 having the lower ends exposed to the suction cavity 54.

The blocking members 56, 56-1, and 56-2 are placed on the suction portions 52, 52-1, and 52-2, respectively, but air is suctioned through the air flow passageways between the surfaces of the blocking members 56, 56-1, and 56-2 and the surfaces of the suction portions 52, 52-1, and 52-2, which are in contact with one another, such that negative pressure is applied to the mold cavity 48, and the molten metal on the respective support portions 41 is introduced into the mold cavity 48 through the passageways 42 of the upper mold 40 which communicate with the mold cavity 48.

Since the ceramic coating 43 with the thermal insulation property is formed on the inner surfaces of the passageways 42, the molten metal is minimally cooled while flowing through the passageways 42 and introduced into the mold cavity 48 in a state in which no crystal is formed.

The molten metal, which is vertically introduced into the mold cavity 48 through the respective passageways 42, forms several branch flows in the mold cavity 48 toward the suction portions by the negative pressure applied from the suction portions 52, 52-1, and 52-2 which are disposed around the lower ends of the respective passageways 42 so as to surround the respective passageways 42, and the flows of the molten metal from the respective passageways 42 are mixed with the flows of the molten metal from the adjacent passageways while colliding with the flows of the molten metal from the adjacent passageways, such that the flows are stopped.

The molten metal fills the mold cavity 48, and the molten metal is rapidly cooled by the upper mold 40 and the lower mold 50 that surround the mold cavity 48, such that the molten metal is solidified in a state in which no crystal is formed, thereby integrally forming an amorphous metal sheet.

While the configuration of the casting mold according to the embodiments of the present invention and the process of casting a sheet made of an amorphous alloy by using the casting mold have been described above, the casting mold according to the present invention and the embodiments is not used only to cast an amorphous alloy, but may be widely applied to a method of drawing a molten metal into a mold cavity by suction and cooling the molten metal.

While the embodiments of the present invention have been described above, the present invention is not limited to the embodiments, various alterations and modifications and addition of constituent elements are enabled within the scope defined by the appended claims, and it is obvious that all of these alterations and modifications and the addition of the constituent elements fall within the scope of the present invention.

The invention claimed is:

1. A casting mold for a metal sheet by drawing molten metal into a mold cavity and cooling the molten metal, the casting mold comprising:
   - a support portion at an upper side on which molten metal is disposed or a solid metal is placed and melted;
   - a mold cavity at a lower side in which the metal sheet is formed as the molten metal is drawn from the support portion while filling the mold cavity and cooled; and
   - a passageway through which the molten metal is drawn into the mold cavity from the support portion,
   - wherein the mold cavity includes a first surface which communicates with the passageway, and a second surface which faces the first surface wherein the first surface is closer to the upper side than the second surface, a plurality of suction portions for drawing the molten metal are formed in the second surface and extended downward from the second surface, the suction portions are connected to a vacuum source and configured to draw the molten metal by suctioning air from the mold cavity, and a blocking member, which is in contact with the second surface or the suction portions to prevent a leakage of the molten metal and allow an air flow, is disposed on the suction portions in the mold cavity.

2. The casting mold of claim 1, comprising:
   - an upper mold which has therein the passageway through which the molten metal is drawn into the mold cavity, and has the support portion at the upper side thereof; and
   - a lower mold which is provided at the lower side of the upper mold and defines the mold cavity between the upper mold and the lower mold,
   - wherein a surface, which defines the first surface of the mold cavity, is formed at the lower side of the upper mold, and a surface, which defines the second surface of the mold cavity, is formed at the upper side of the lower mold.

3. The casting mold of claim 2, wherein a protruding portion, which protrudes toward the mold cavity and is in contact with a portion of the second surface of the mold cavity where the suction portions are formed, is provided at the lower side of the upper mold, and the protruding portion defines the blocking member.

4. The casting mold of claim 3, wherein an outer circumferential surface of the protruding portion is in contact with a circumferential surface between the first surface and the second surface of the mold cavity, and an inner circumferential surface of the protruding portion, together with the first surface and the second surface of the mold cavity, defines a space corresponding to a shape of the metal sheet.

5. The casting mold of claim 1, wherein a thermal insulator or a thermal insulation coating is provided in the passageway.

6. The casting mold of claim 1, wherein a common space, which communicates with the vacuum source, is provided at the lower side of the suction portions.

7. The casting mold of claim 1, further comprising:

a coolant passageway which is formed to cool the casting mold.

8. The casting mold of claim 1, wherein the suction portion is formed in the second surface of the mold cavity so as to be adjacent to a circumferential surface between the first surface and the second surface of the mold cavity, and the blocking member has surfaces which are in contact with the first surface, the second surface, and the circumferential surface of the mold cavity.

9. The casting mold of claim 8, wherein the blocking member is configured by a ring disposed in the mold cavity, and the ring is disposed on the upper side of the suction portion and is in contact with the circumferential surface of the mold cavity, a part of the first surface adjacent to the circumferential surface, and a part of the second surface adjacent to the circumferential surface.

10. The casting mold of claim 9, wherein an inner surface of the ring, together with the first surface and the second surface of the mold cavity, defines a space corresponding to a shape of the metal sheet.

11. The casting mold of claim 1, wherein a surface of the blocking member, which is in contact with the second surface of the mold cavity, has surface roughness that allows an air flow from the mold cavity to the suction portion.

12. The casting mold of claim 1, wherein a plurality of the support portions and a plurality of the passageways are formed, the molten metal, which is introduced into the mold cavity from the respective passageways, forms flows of the molten metal toward the adjacent suction portions, and the suction portions are disposed between the passageways on a plane of the mold cavity so that the flows of the molten metal are contact with the flows of the molten metal from the adjacent passageways.

13. The casting mold of claim 12, wherein the suction portion is concavely formed downward from the second surface of the mold cavity, a suction hole, which communicates with the vacuum source, is formed in a bottom surface of the suction portion, the blocking member is formed in a shape complementary to the suction portion, an upper surface of the blocking member is placed on the suction portion so as to define a part of the second surface of the mold cavity, and an air flow passageway from the mold cavity to the suction hole is formed between the blocking member and the suction portion.

14. The casting mold of claim 13, wherein any one of a surface of the blocking member and a surface of the suction portion, which are in contact with each other, has surface roughness that allows an air flow from the mold cavity to the suction hole.

15. The casting mold of claim 12, wherein the respective suction portions are disposed to be spaced apart from the passageways on a plane of the mold cavity, and the respective suction portions are disposed at equal distances from the adjacent passageways.

16. The casting mold of claim 12, wherein any one of a surface of the blocking member and a surface of the suction portion, which are in contact with each other, has surface roughness that allows an air flow from the mold cavity to the suction hole.

* * * * *